US011946174B2

(12) United States Patent
Van Tassell

(10) Patent No.: US 11,946,174 B2
(45) Date of Patent: Apr. 2, 2024

(54) CONTINUOUS STRAND WEAVING PENTAGON PIN LOOMS AND METHODS OF USE

(71) Applicant: BLUEBONNET CRAFTERS, LLC, San Marcos, TX (US)

(72) Inventor: Gabriele Van Tassell, San Marcos, TX (US)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 17/863,022

(22) Filed: Jul. 12, 2022

(65) Prior Publication Data

US 2022/0341068 A1 Oct. 27, 2022

Related U.S. Application Data

(63) Continuation-in-part of application No. 16/247,471, filed on Jan. 14, 2019, now Pat. No. 11,408,101.
(Continued)

(51) Int. Cl.
*D03D 29/00* (2006.01)
*D03D 3/06* (2006.01)
(Continued)

(52) U.S. Cl.
CPC ..... *D03D 29/00* (2013.01); *D03D 3/06* (2013.01); *D03D 13/002* (2013.01); *D03D 13/004* (2013.01); *D03D 33/00* (2013.01)

(58) Field of Classification Search
CPC ..... D03D 29/00; D03D 3/06; D03D 13/002; D03D 13/004; D03D 33/00
(Continued)

(56) References Cited

U.S. PATENT DOCUMENTS 2,159,264 A 5/1939 Gash
2,159,265 A 5/1939 Gash
(Continued)

FOREIGN PATENT DOCUMENTS

CN 202744723 U 2/2013
JP 62263346 A 11/1987

OTHER PUBLICATIONS

Haig, Catherine. "Pentagon Weave 1." Youtube. Oct. 25, 2015. https://www.youtube.com/watch?v=2wCrt7QaEZ0 (Year: 2015).*
(Continued)

*Primary Examiner* — Grace Huang
(74) *Attorney, Agent, or Firm* — HULSEY P.C.

(57) ABSTRACT

A method and a system for forming a pentagonal woven fabric including a pentagon pattern loom. The pentagon pattern loom includes loom pins. The loom pins are arranged in a pentagonal pattern to form a structure for engaging a continuous yarn strand. The loom pins include a first pin, a second pin, a third pin, a fourth pin, and a fifth pin positioned at the edges of the pentagonal pattern with center pins therebetween. A bias weaving process uses the continuous yarn strand for forming a top woven triangle fabric section, a bottom woven triangle fabric section, and a middle section of parallel yarn strand portions of the single continuous yarn strand. A second continuous weaving uses the continuous yarn strand as weft strands in the middle section of parallel yarn strand portions for forming a rectangular woven fabric section with remaining loom pins of the pentagonal pattern.

5 Claims, 24 Drawing Sheets

Related U.S. Application Data

(60) Provisional application No. 62/617,249, filed on Jan. 14, 2018.

(51) Int. Cl.
*D03D 13/00* (2006.01)
*D03D 33/00* (2006.01)

(58) Field of Classification Search
USPC ..... 139/383 AA, 1 R, 29; 66/3, 4
See application file for complete search history.

(56) References Cited

U.S. PATENT DOCUMENTS

| | | | | | |
|---|---|---|---|---|---|
| 2,186,692 | A | | 1/1940 | Boyer | |
| 2,199,515 | A | * | 5/1940 | Woods | D03D 29/00 139/34 |
| 2,424,880 | A | * | 7/1947 | Robertson | D03D 29/00 139/33 |
| 2,433,307 | A | | 12/1947 | Wimberly | |
| 2,780,854 | A | | 2/1957 | Dritz | |
| 3,347,281 | A | | 10/1967 | Stars | |
| 3,748,706 | A | | 7/1973 | Doyel | |
| 3,966,207 | A | | 6/1976 | Pass | |
| 4,023,245 | A | | 5/1977 | Zaltzman | |
| 4,041,585 | A | | 8/1977 | Berger | |
| 4,044,437 | A | | 8/1977 | Ebenstein | |
| 5,146,659 | A | * | 9/1992 | Spriggs, II | D03D 29/00 139/34 |
| 5,435,048 | A | | 7/1995 | Walker | |
| 8,141,395 | B2 | | 3/2012 | Dillavou | |
| 8,316,894 | B2 | * | 11/2012 | Schaub | D04B 3/00 139/34 |
| 9,695,527 | B1 | | 7/2017 | Clement | |
| 9,695,530 | B2 | | 7/2017 | Hall | |
| 10,704,645 | B2 | | 7/2020 | Gao | |
| 11,401,634 | B2 | * | 8/2022 | Smith | D03D 29/00 |
| 2010/0275764 | A1 | | 11/2010 | Egres, Jr. | |
| 2016/0249594 | A1 | | 9/2016 | Gunnarsson | |
| 2017/0268139 | A1 | | 9/2017 | Peerzada | |
| 2018/0085683 | A1 | | 3/2018 | Urso | |
| 2018/0140085 | A1 | | 5/2018 | Mills | |
| 2021/0123169 | A1 | * | 4/2021 | Novak | D04B 3/00 |

OTHER PUBLICATIONS

Hoffman, Gordon. "Pentagon pin loom weaving." Youtube. Mar. 17, 2022. https://www.youtube.com/watch?v=OED4lqKX9Hs (Year: 2022).*

Texasgabi. "Meet Jewel!" Turtle Looms-Hexagon Pin Loom Weaving. Mar. 31, 2022. https://turtleloom.com/2022/03/31/meet-jewel/ (Year: 2022).*

Ackwood, Jennifer, director, Hexagon Loom Tutorial. YouTube, YouTube, Aug. 9, 2017, www.youtube.com/watch?v=PnoEH_k3aEw. (Year:2017).

Bluebonnet Crafters, LLC, director. How to Weave a Hexagon on a Pin Loom (All-In-One Version). YouTube, YouTube, Apr. 19, 2017, www.youtube.com/watch?v-w2dBsmq0H7c. (Year: 2017).

* cited by examiner

CONTINUOUS STRAND WEAVING PENTAGON PIN LOOMS AND METHODS OF USE

CROSS REFERENCE TO RELATED APPLICATIONS

The present application is a continuation-in-part (CIP) application of U.S. patent application Ser. No. 16/247,471, which claims priority from U.S. Provisional Patent Application No. 62/617,249 filed Jan. 14, 2018, and titled "Continuous Strand Weaving Hexagon Pin Looms and Methods of Use," with BLBC001US0; all of which are incorporated herein in their entirety and referenced thereto.

FIELD OF THE INVENTION

The present disclosure relates to continuous strand weaving hexagon pin looms, pentagon pin looms and methods of use.

BACKGROUND OF THE INVENTION

Weaving is a method of textile production in which two distinct sets of yarns or threads are interlaced at right angles to form a fabric or cloth. Other methods are knitting, crocheting, felting, and braiding or plaiting. The longitudinal threads are called the warp and the lateral threads are the weft or filling. Weft is an old English word meaning "that which is woven." The method in which these threads are inter-woven affects the characteristics of the cloth. Cloth is usually woven on a loom, a device that holds the warp threads in place while filling threads are woven through them. A fabric band which meets this definition of cloth (warp threads with a weft thread winding between) can also be made using other methods, including tablet weaving, back strap loom, or other techniques without looms.

The way the warp and filling threads interlace with each other is called the weave. Woven cloth can be plain (in one color or a simple pattern) or can be woven in decorative or artistic design.

In general, weaving involves using a loom to interlace two sets of threads at right angles to each other: the warp which runs longitudinally and the weft that crosses it. One warp thread is called an end and one weft thread is called a pick. The warp threads are held taut and in parallel to each other, typically in a loom.

Although weaving is an ancient craft, there are needs for improvements and innovations in the manufacture and use of looms for weaving and processes for using them. These needs give rise to invention to address new solutions.

SUMMARY

In light of the above problems, the disclosed subject matter includes method and system for continuous strand weaving hexagon pin looms, pentagon pin looms and methods of use.

According to one aspect, the disclosed subject matter provides a method for forming a hexagonal woven fabric, comprising the steps of providing a single continuous yarn strand for forming the hexagonal woven fabric. The method and system using such method provide a hexagonal pattern loom. The loom includes a plurality of loom pins perpendicularly embedded into the loom frame and a protruding predetermined distance for engaging and holding the single continuous yarn strand. The loom pins are arranged in a hexagonal pattern to form a structure for engaging continuous yarn strand. A first predetermined subset of the loom pins form a top angled side of the hexagonal pattern. A second predetermined subset of the loom pins form a bottom angled side of the hexagonal pattern. A third predetermined subset of the loom pins form two opposite straight sides of the hexagonal pattern, the two opposite straight sides connect to the top angled side and the bottom angled side to form the pin spacing for the hexagonal pattern loom.

A bias weaving process uses the continuous yarn strand for forming a top woven triangle fabric section, a bottom woven triangle fabric section, and a middle section of parallel yarn strand portions of the single continuous yarn strand, the middle section forms a plurality of weaving warps for continuing to weave using the single continuous yarn strand.

Traditional back-and-forth weaving uses the continuous yarn strand as weft strands in the middle section of parallel yarn strand portions for forming a rectangular woven fabric section. Upon completing the back-and-forth weaving step, the top woven triangle fabric section, bottom woven triangle fabric section, and the rectangular woven fabric section form a hexagonal woven fabric using the continuous yarn strand. The method and system further include the step of and means for separating the hexagonal woven fabric from the hexagonal pattern loom.

According to another aspect, the disclosed subject matter provides a method and a system for forming a pentagonal woven fabric. The system includes a single continuous yarn strand, and a pentagonal pattern loom. The pentagonal pattern loom includes a loom frame. The pentagonal pattern loom includes a plurality of loom pins. The plurality of loom pins embeds perpendicularly into the loom frame and protrudes at a predetermined distance for engaging and holding the single continuous yarn strand. The plurality of loom pins is arranged in a pentagonal pattern to form a structure for engaging the single continuous yarn strand.

The loom pins include a first pin, a second pin, a third pin, a fourth pin, and a fifth pin positioned at the edges of the pentagonal pattern with center pins therebetween. The first pin, the second pin, the third pin, and the fourth pin form a hexagonal configuration with the center pins between the first pin and the fifth pin and the center pins between the fourth pin and the fifth pin.

The hexagonal configuration includes a first predetermined subset of the loom pins that forms a top angled side of the hexagonal configuration. The hexagonal configuration includes a second predetermined subset of the loom pins that forms a bottom angled side of the hexagonal configuration. The hexagonal configuration includes a third predetermined subset of the loom pins that forms two opposite straight sides of the hexagonal configuration. The two opposite straight sides connect to the top angled side and the bottom angled side to form the loom pins spacing for the hexagonal configuration.

The center pins between the first pin and the fifth pin and the center pins the fourth pin and the fifth pin form a triangular configuration.

The top angled side and the bottom angled side support bias weaving using the single continuous yarn strand for forming a top woven triangle fabric section, a bottom woven triangle fabric section, and a middle section of parallel yarn strand portions of the single continuous yarn strand. The middle section forms a plurality of weaving warps for continuing to weave using the single continuous yarn strand. The middle section of parallel yarn strand portions of the single continuous yarn strand for supporting a second continuous weaving using the single continuous yarn strand as weft strands to form a rectangular woven fabric section with remaining loom pins in the triangular configuration of the pentagonal pattern. Here, the second continuous weaving refers to a different continuous strand weaving method that allows to weave the "triangular configuration" or "prolonged triangular weaving" that is remaining in the pentagonal pattern. The second continuous weaving is performed to extend each weaving turn to fill in the center of the hexagon shape, while building the triangle that is needed to turn the hexagon to a pentagon pattern. Upon completing the second continuous weaving, the top woven triangle fabric section, the bottom woven triangle fabric section, and the rectangular woven fabric section with a triangular extension form a pentagonal woven fabric using the single continuous yarn strand.

BRIEF DESCRIPTION OF THE DRAWINGS

The novel features believed characteristic of the disclosed subject matter are set forth in claims that are filed herewith. The disclosed subject matter itself, however, as well as the preferred mode of use, further objectives, and advantages thereof, will best be understood by reference to the following detailed description of an illustrative embodiment when read in conjunction with the accompany drawings, wherein:

DETAILED DESCRIPTION OF THE EMBODIMENTS

One or more embodiments of the invention are described below. It should be noted that these and any other embodiments are exemplary and are intended to be illustrative of the invention rather than limiting. While the invention is widely applicable to different types of systems, it is impossible to include all the possible embodiments and contexts of the invention in this disclosure. Upon reading this disclosure, many alternative embodiments of the present invention will be apparent to persons of ordinary skill in the art.

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Figure 1:
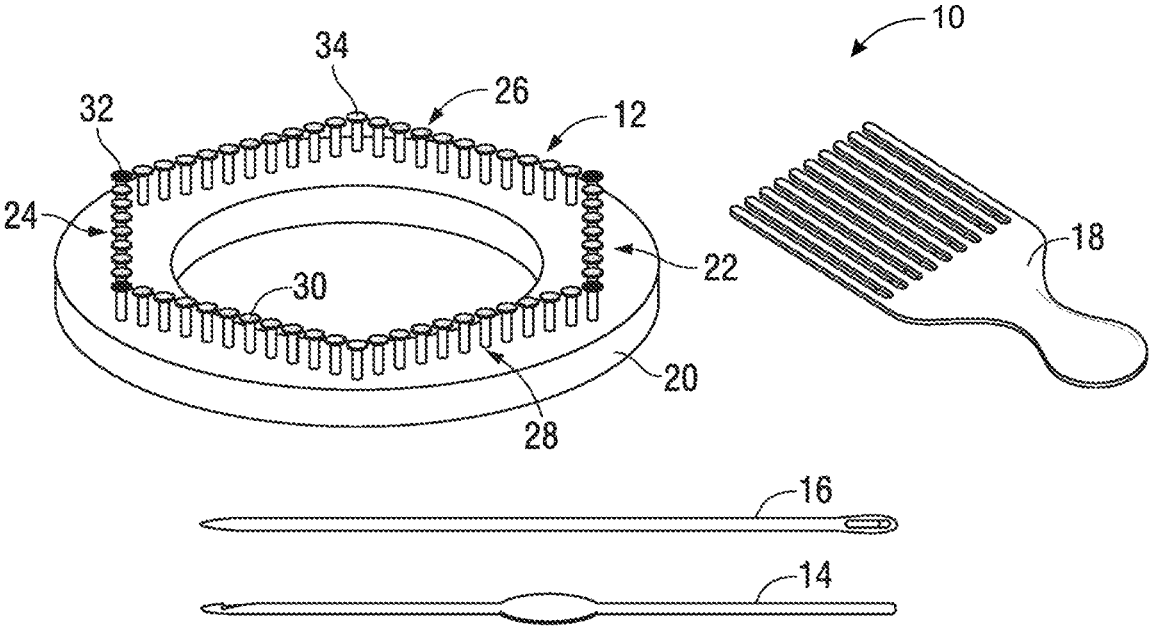
FIG. 1 shows the components of a kit including the continuous strand weaving pin loom of the present disclosure.

FIG. 1 shows continuous strand weaving pin loom or "turtle" loom kit 10 of the present disclosure. Turtle loom kit 10 includes turtle loom 12, rocker hook 14, weaving needle 16 and packing comb 18. Turtle loom 12 includes a hexagonal arrangement of pins vertically positioned in frame 20 on surface 22 in a predetermined arrangement. The spacing for each of the pins 20 depends on whether the pin is on a side position such as pins 24 or an angle side such as pins 26 and 28. Rocker hook 14 permits manipulation of strands from which turtle loom 12 will construct the hexagon woven fabric is here described.

In addition to the tools that come with the kit, there is the need for the user to have yarn from which to make the hexagon woven fabric. In general, any worsted weight yarn may be used (for the standard spaced looms). There is a broad spectrum of yarns that can be used with the presently disclosed loom.

Pins on the turtle loom 12 have different colors. Colored or brown pins 30, black pins 32, and white pins 34 have the same size and form integral pieces of hexagon loom pin arrangement 36. The upper and lower white pins 34 provide the connection for starting the hexagon weaving process. In addition, the turtle loom includes four black pins 32. The four black pins 32 are positioned at the other four corners not occupied by the two white pins. The four black pins 32 provide the position at which the hexagon weaving process shifts from bias weaving to traditional weaving, as further described below, in completing the hexagon woven fabric of the present disclosure. The black pins 32 and white pins 34 may be replaced by other means to indicate the location of these pins (for example, carved "x" and "o" or rings/lines near or around those pins), to guide the user in the weaving process. In such case, all of hexagon loom pin arrangement 36 may have the same color pins.

Figure 2:
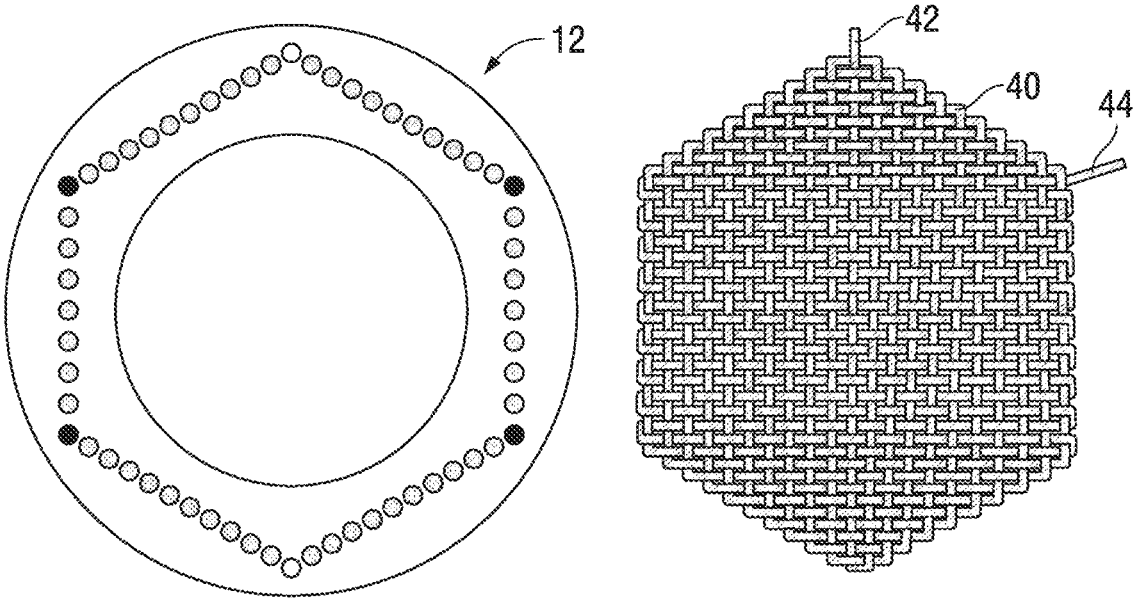
FIG. 2 illustrates a medium sized continuous strand weaving pin loom according to the present disclosure and the hexagon weave pattern resulting from use of loom.

FIG. 2 illustrates a medium-sized continuous strand weaving pin loom according to the present disclosure and the hexagon weave pattern resulting from use of loom. FIG. 2 shows hexagon woven fabric 40. Connecting to hexagonal woven fabric 40 are warp yarn strand 42 and weft yarn strand 44. By providing different pin spacing at different portions of the hexagon loom pin arrangement 36 and combining the two different weaving methods, a symmetrical hexagonal pattern results (i.e., equally evenly distributed woven pattern). The goal of creating the hexagons is to create a fabric where the strands that go horizontally and vertically are evenly spread out.

The two weaving methods are performed at different times in the weaving process and the pins are spaced so as to support the use of the two different weaving methods. This first method is sometimes referred to as "bias" weaving. The bias weaving method is used to create a top woven fabric triangle, a bottom woven fabric triangle, and vertical threads within the hexagon loom pin arrangements 36 which will serve as the warps for the traditional weaving described below. The vertical warps are formed, the upper and lower triangles are formed in the hexagon pattern.

Once the triangles are formed, the method changes to the "traditional" weaving method. The traditional weaving method employs weaving back-and-forth over the warps. In doing so, a weaving needle 16 goes under and over the threads that were formed in the bias weaving method. Thus, the warps are the vertical threads in the pattern and provide the structure through which the weft thread may be woven over and under across the warps to create the center part of the hexagon pattern.

Figure 3A:
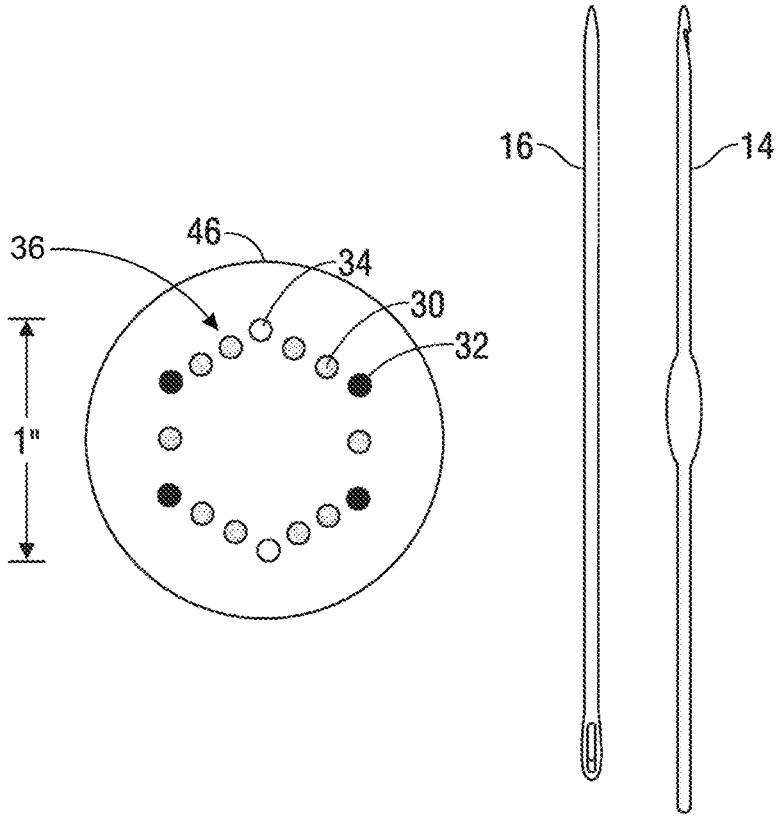
FIGS. 3A and 3B illustrate small-sized embodiments of the continuous strand weaving pin loom according to the teachings of the present disclosure, including a 1" loom (FIG. 3A) and a 2" loom (FIG. 3B)
Figure 3B:
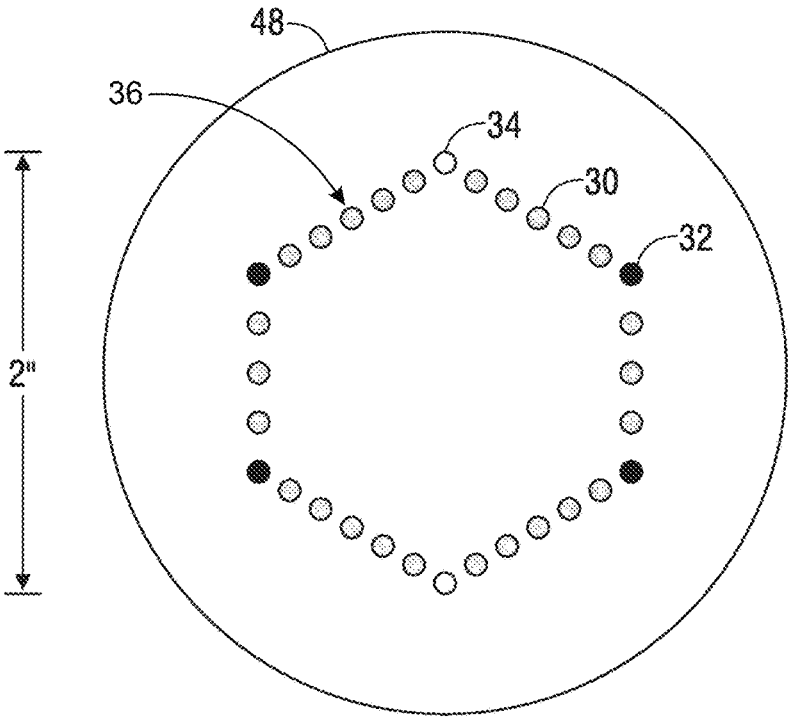
Figure 4:
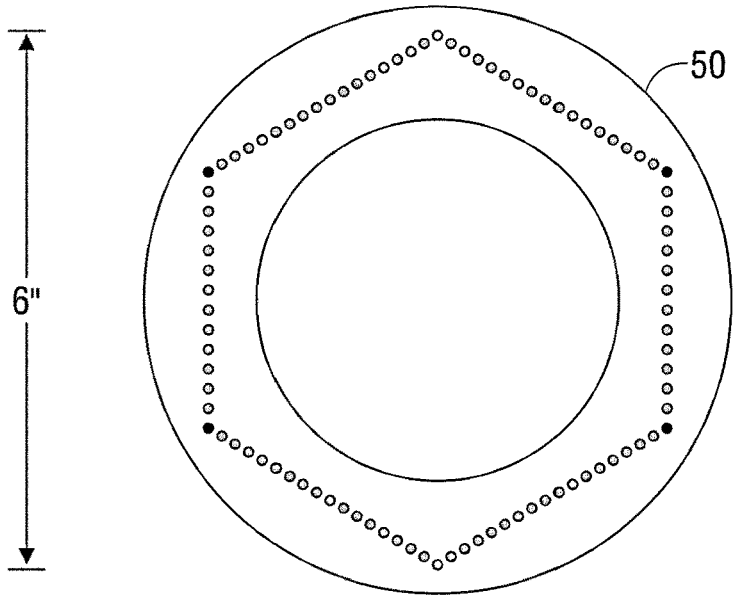
FIG. 4 shows a large embodiment (6" diameter) of the continuous strand weaving pin loom of the present disclosure.

Loom frame 20 may measure various sizes. This may include a much smaller or a much larger arrangement from which hexagons of smaller and larger sizes, respectively, may be formed. FIGS. 3A and 3B illustrate small-sized embodiments of the continuous strand weaving pin loom according to the teachings of the present disclosure, including a 1" loom 46 (FIG. 3A) and a 2" loom 48 (FIG. 3B). FIG. 4 illustrates a significantly larger turtle loom 50 for forming larger hexagonal patches than either turtle loom 46 or 48. Larger turtle loom 50 has a diameter of 6" and presently sells under the brand "TexaTURTLE™" Hexagon Pin Loom Kit by Bluebonnet Crafters of San Marcos, Texas, the applicant hereof.

Figure 5A:
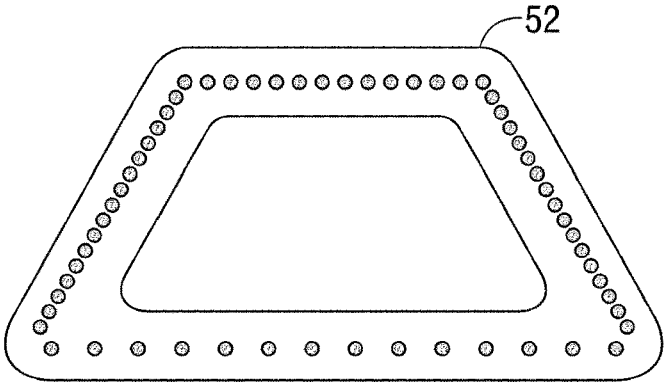
FIGS. 5A and 5B depict alternative embodiments of half-hexagon continuous strand weaving pin looms within the scope of the present disclosure.
Figure 5B:
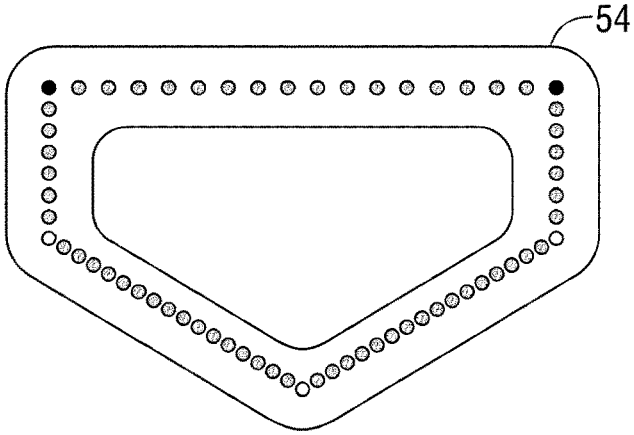

FIGS. 5A and 5B depict alternative embodiments of half-hexagon continuous strand weaving pin looms within the scope of the present disclosure. In both of these half hexagon looms, differently spaced pins provide the evenly spaced weave for forming a half hexagon woven fabric. By nature, hexagons have two different ways to cut them in half. Each of the half hexagons depend on the symmetrical aspects of the hexagon. The angle half hexagon pin loom 52 depends on the symmetry across the angles of a hexagon. Side half hexagon loom 54 depends on the symmetry across the sides of the hexagon.

Figure 6:
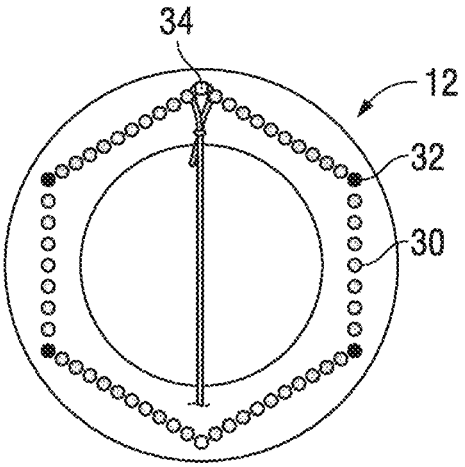
FIGS. 6 through 22 depict various aspects of methods for using the present fully disclosed continuous strand weaving pin looms.
Figure 7:
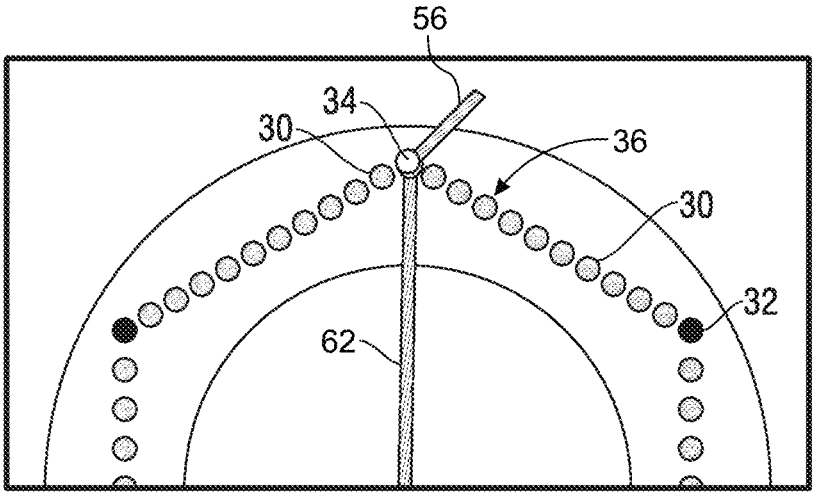

FIGS. 6 through 22 depict various aspects of methods for using the present fully disclosed continuous strand weaving pin looms. FIG. 6 shows the initial steps in the sequence of the weaving process. The weaving process begins with forming on continuous yarn strand a slip knot. FIG. 7 shows the loop of yarn strand 56 over top white pin 34, considered the starting pin. White pins 34 help the weaver get started in the bias weaving process. Yarn strand 56 is pulled down to become warp strand 62.

Figure 8:
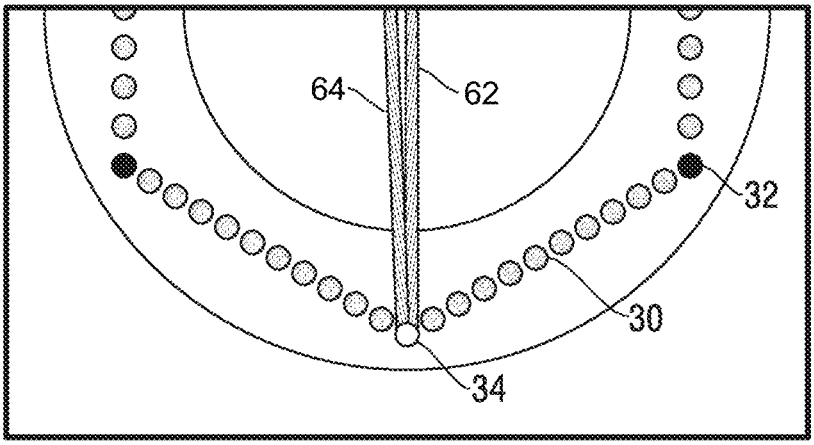
Figure 9:
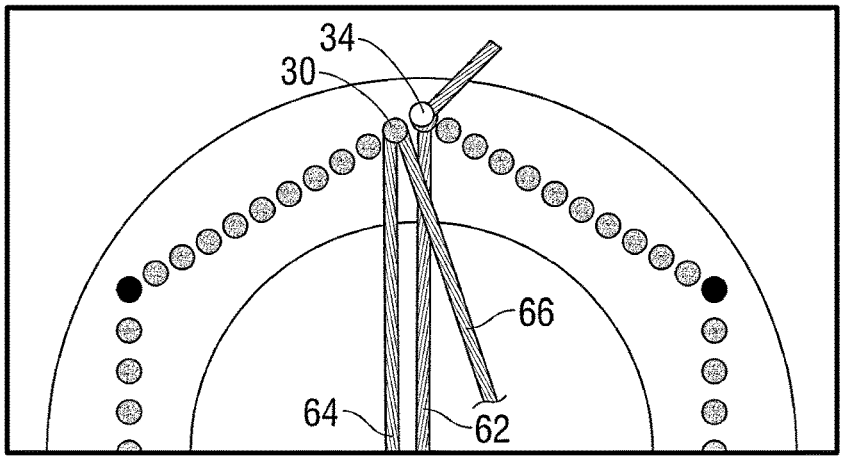
Figure 10:
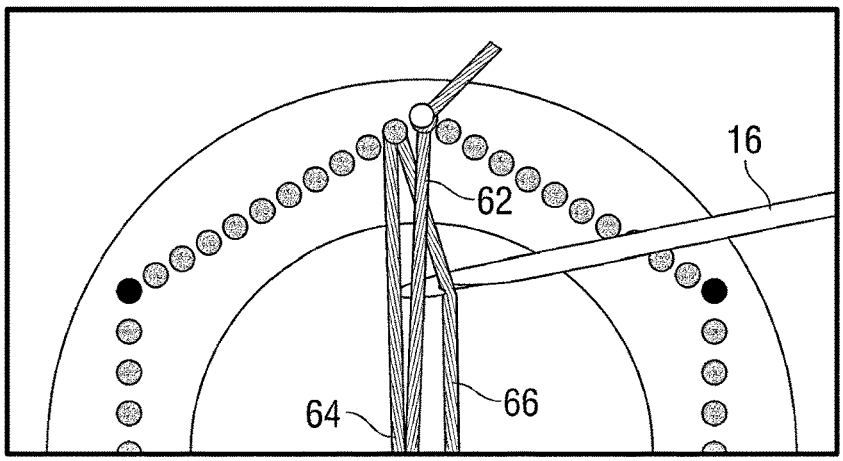
Figure 11:
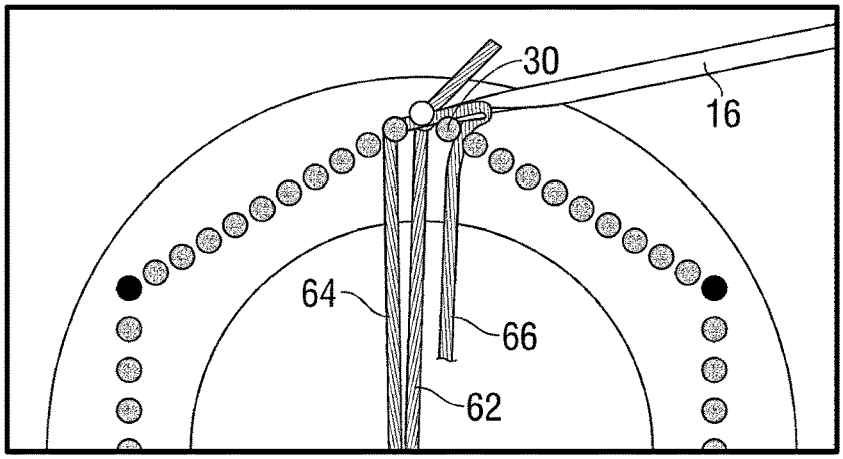
Figure 12:
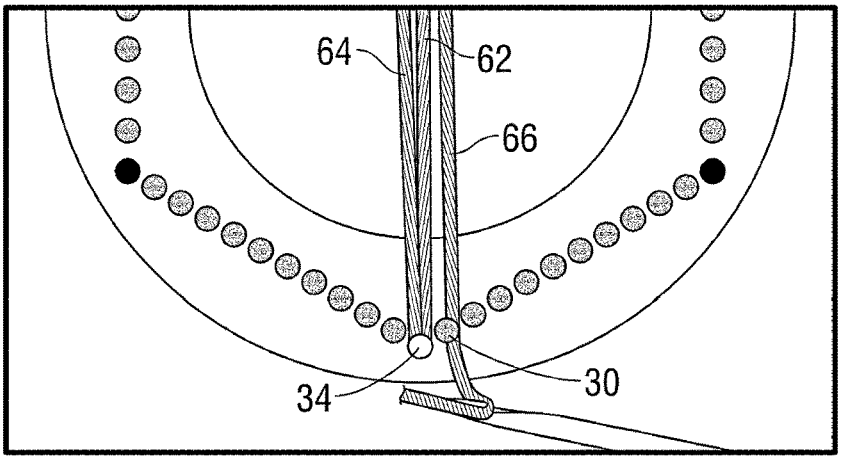
Figure 13:
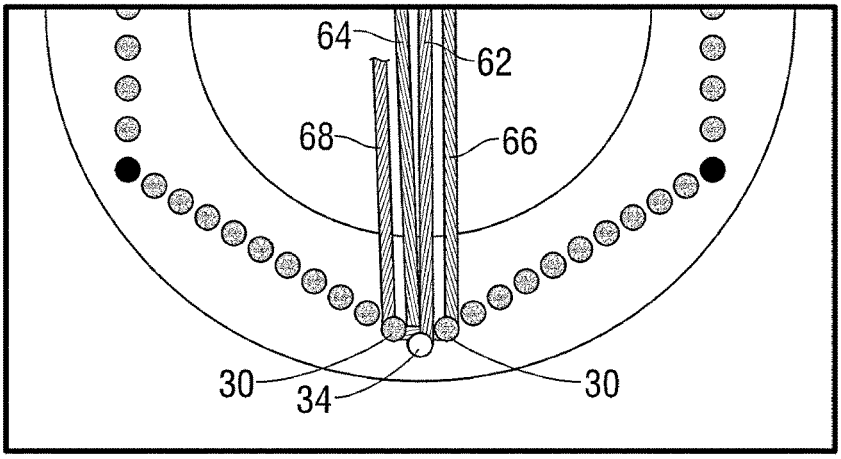

In FIG. 8 the weaver takes yarn strand 56 around the bottom white pin 34 from the right to the left and then back up forming warp strand 62. The weaving process continues in a clockwise fashion. In FIG. 9 the weaver returns to the top of loom 12, where warp strand 64 is to be threaded from the left to the right around the first brown pin 30 to the left of white pin 34 at the top angle of loom pin arrangement 36. FIG. 10 shows the weaver bringing warp strand 66 to be pulled under warp strand 62. FIG. 11 shows warp strand 66 is to be taken over first brown pin 30 to the right of white top starting pin 34. In FIG. 12, the workings of thread slides down to duplicate the weave down to the bottom triangle of the hexagon. In FIG. 12 warp strand 66 is guided around the first brown pin 30 to the right of bottom white pin 34. Warp strand 68 comes out to the left and weaves the first row of what will become the bottom triangle woven fabric segment. FIG. 13 shows this step of the process of taking warp strand 68 to the next brown pin 30 on the left side of bottom white pin 34.

Figure 14:
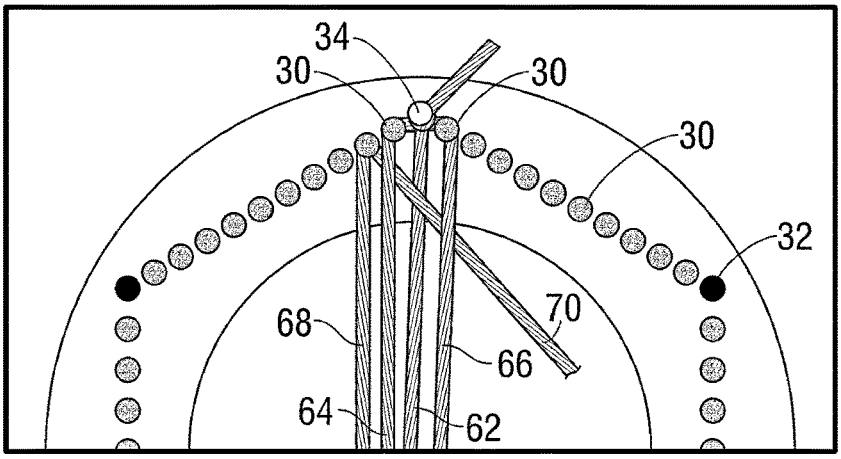
Figure 15:
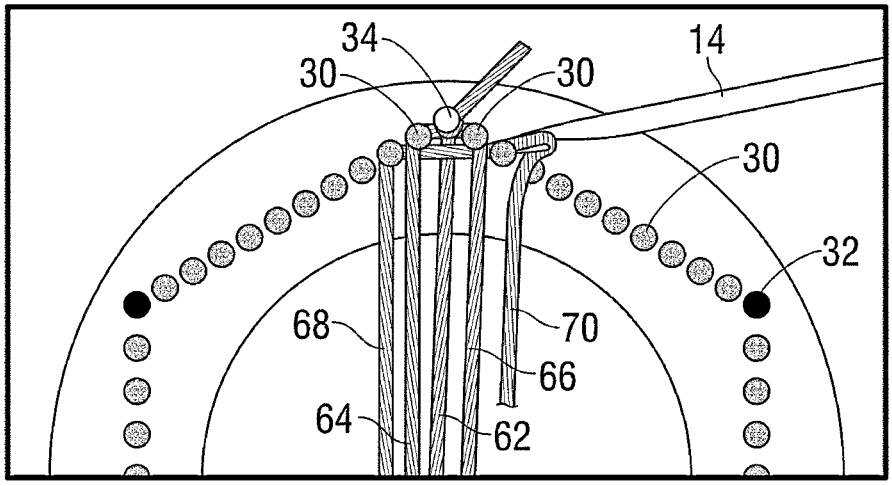

In FIG. 14 the weaver guides warp strand 68 to the next available brown pin 30 on the left at the top. Then, using rocker hook 14, the weaver guides warp strand 70 under warp strands 62 and 64. Warp strand 70 is now to go around brown pin 30. FIG. 15 is the next step in the weaving process using the rocker hook 14 going over brown pin 30.

Figure 16:
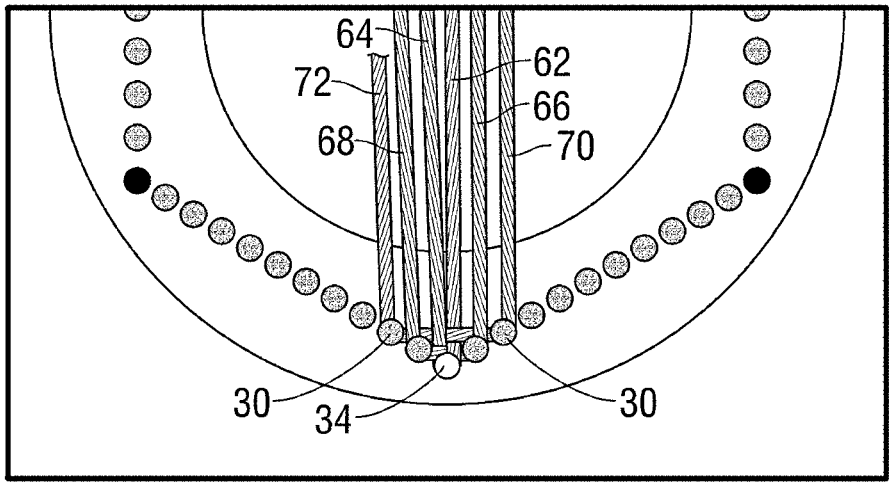

In FIG. 16, the weaver guides warp strand 70 over the next available brown pin 30 to the right of bottom white pin 34. The weaver guides with the rocker hook the working thread down to the bottom. Then the thread is placed over the next available brown pin to the right and the next available brown pin on the left.

Strand 72 then continues to the next available brown pin on the top left. The weaver, thus, weaves at the top and then guides the working thread down to the bottom which automatically performs the placement in the bottom. This continues until the completion of a top triangle woven fabric section and bottom triangle woven fabric section.

At this point the horizontal yarn threads may show small arches within the weave. The arches indicate a proper tension in the woven fabric. In order to remove the arches, which is desirable for the construction of the hexagon woven fabric, packing comb 18 may be used to straighten those arched threads. The bias weaving method continues until the black pins are covered with the yarn and the working thread comes out at the bottom left black pin.

Figure 17:
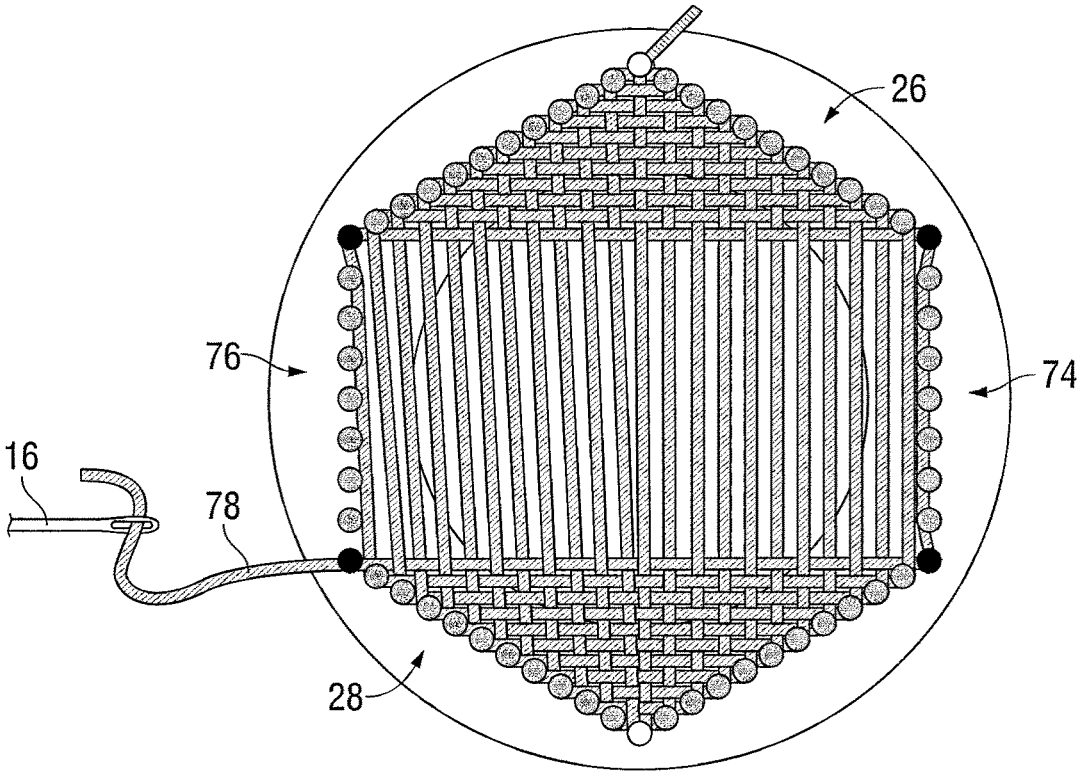
Figure 18:
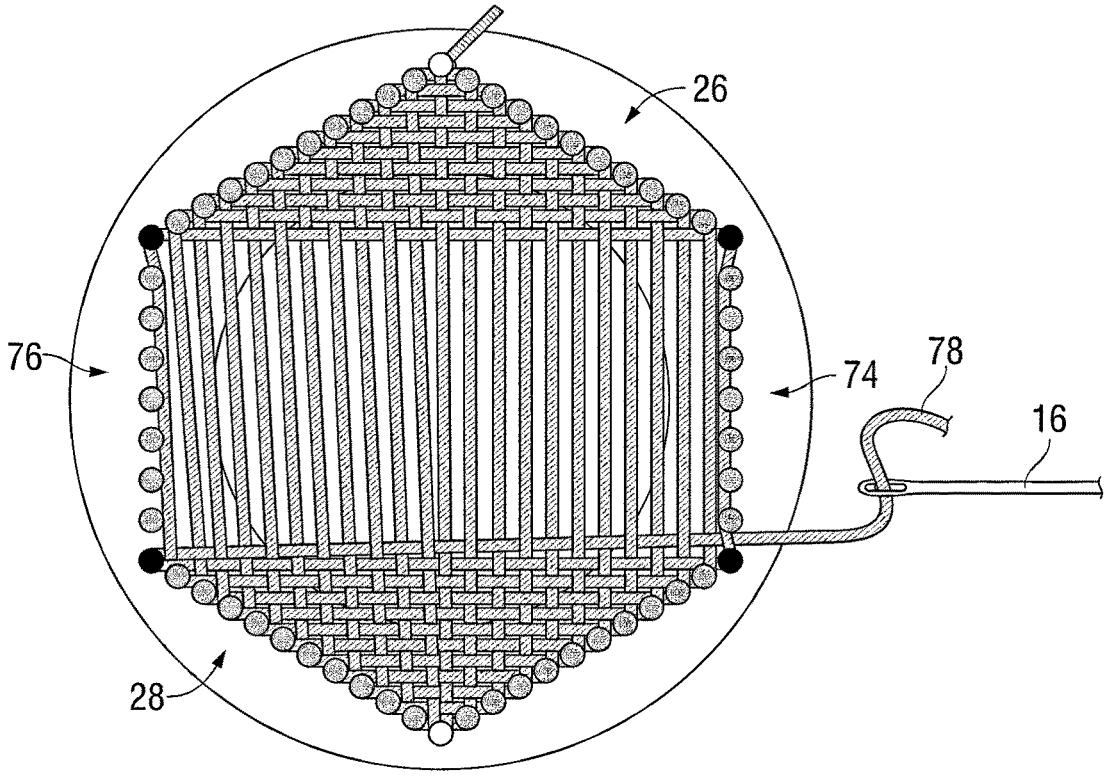

FIGS. 17 and 18 show this stage in the process. At this point, all brown pins 30 should have yarn around them at the bottom and top triangles. The yarn covers all brown pins 30 on the top and bottom size above the two black pins 32 in top angled side 26 and bottom angled side 28. This shows a triangle weave configuration at the top and the bottom portions of the woven fabric.

FIG. 17 shows that pin spacing on the side pins 74 and 76 is a little farther apart than on the top 26 and bottom 28 angled sides. For these pins there is not yet any yarn going around them. FIG. 18 shows the yarn preparation for the second part, the traditional leaving method part, of the disclosed process. For the original dimensions of the turtle loom the process includes wrapping the working yarn around the loom five times. Again, consider that a number of times around the loom that the yarn needs to be wrapped will depend on several factors. These include the thickness of the yarn, the size of the loom, and the spacing between the pins 30 in the loom 12, as well as other factors such as the elasticity of the continuous yarn strand 56. By wrapping yarn strand 56 around loom 12 hexagon forming pins, a pre-measurement of the working thread for the traditional weaving part of the disclosed process can be accurately estimated.

FIGS. 17 and 18 show the point at which the weaving method shifts from the bias method to the traditional method of weaving. Beginning the traditional weaving method, weaving needle moves back and forth over and under the vertical warp strands to complete the middle-woven segment pattern while stepping up through looping around the side brown pins 74. This process fills the center section of the hexagon. Thus, in the use of the traditional method, the vertical warps that were established in the bias weaving method are now used by the horizontal weft in back-and-forth traditional weaving method. This places horizontal wefts in an escalating fashion up from the bottom triangle of the hexagon fabric to ultimately reach the top triangle.

Figure 19:
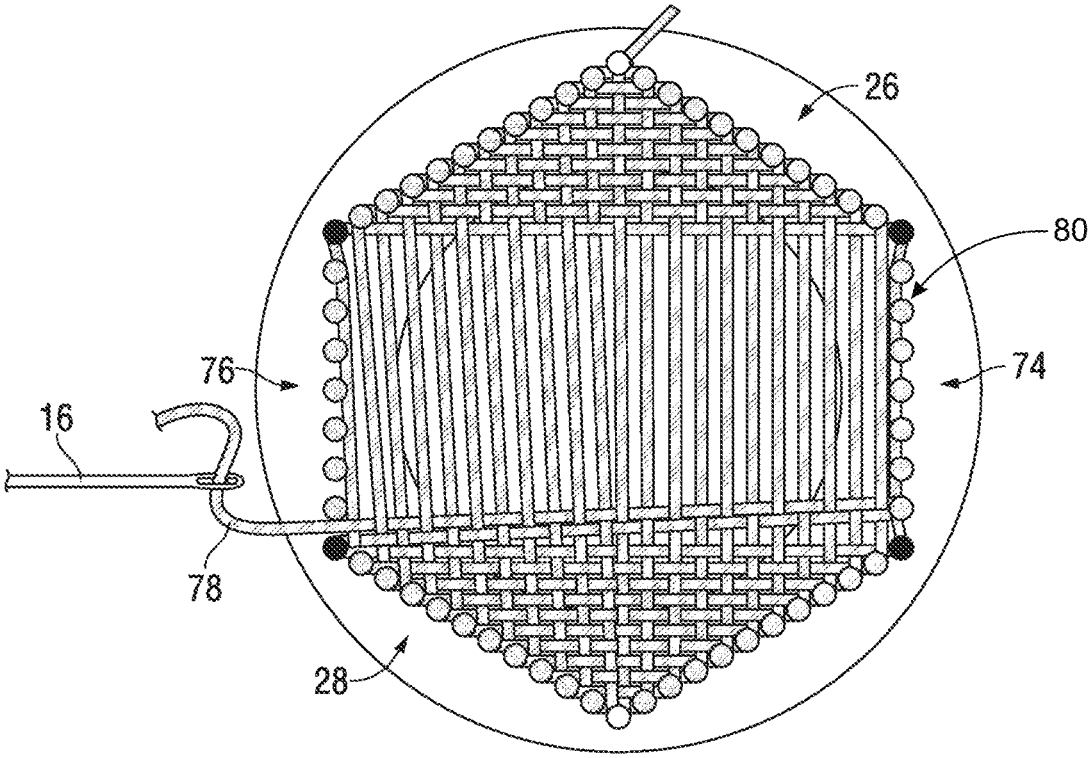
Figure 20:
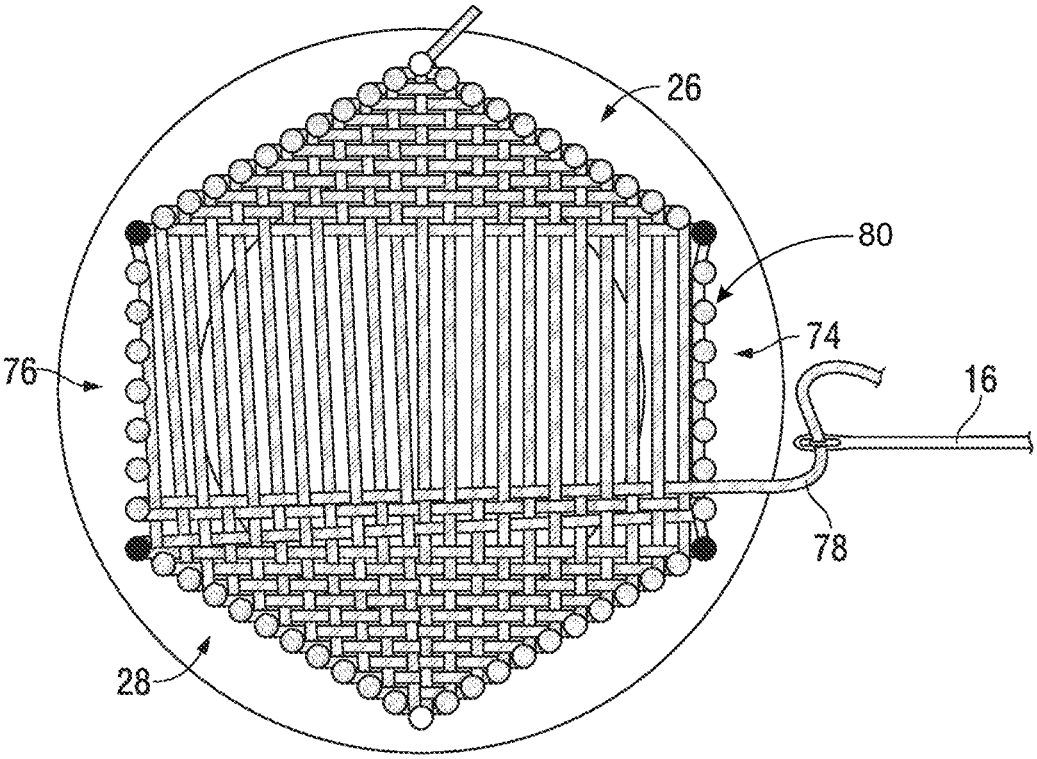
Figure 21:
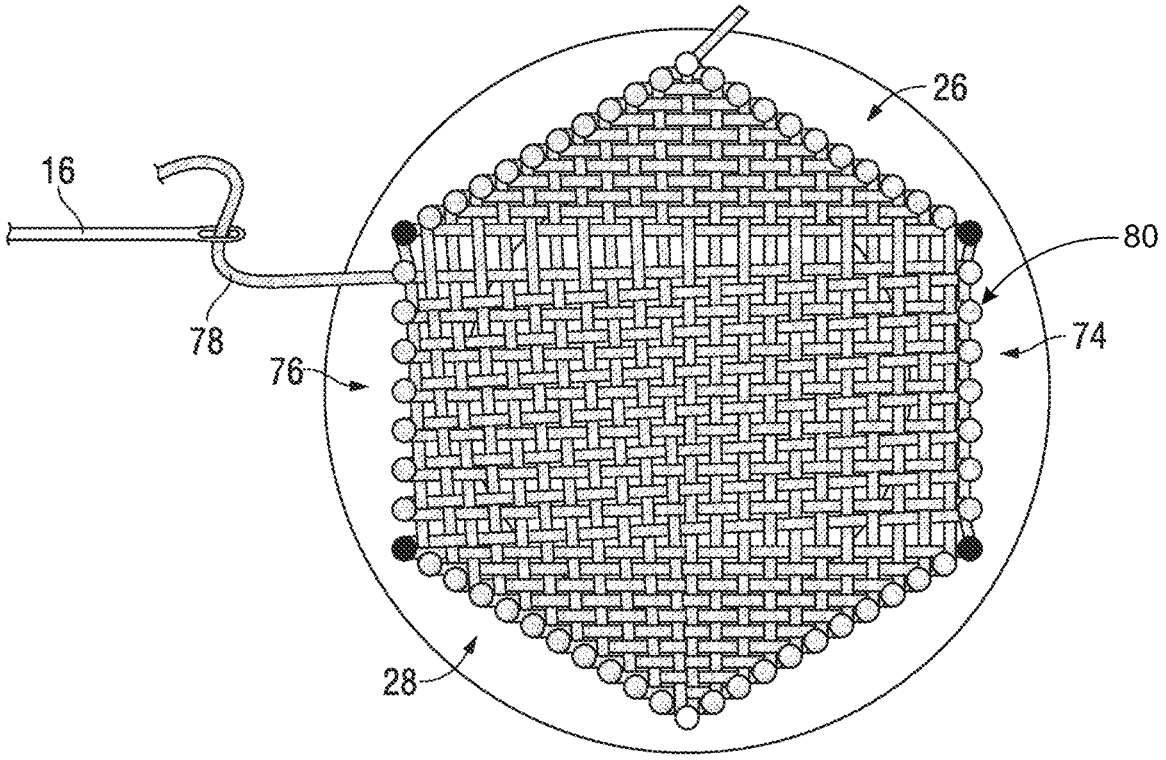
Figure 22:
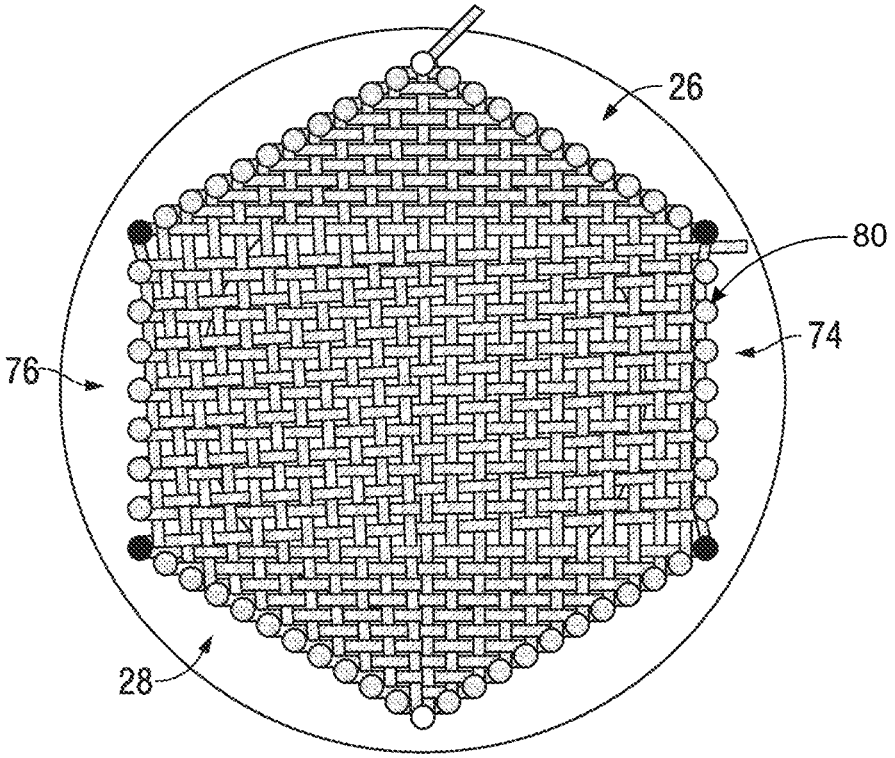

FIGS. 19 through 22 show how the traditional method fills the remaining rows in the middle section 80 of the hexagonal woven fabric. FIG. 19 shows that the weaving direction comes up from the bottom. The weaver works his way up the vertical strands to fill-in the middle section of the woven fabric. FIG. 21 is the weaving of the last row and FIG. 22 is the completed hexagon woven fabric 40.

Once the last row is woven in the middle section, the weaver can remove the hexagon woven fabric 40 from the turtle loom. To take the hexagon off the loom with color-coded headed pins, first use the weaving needle to loosen the slip knot at the starting pin. Then, using the weaving needle 16, the process entails sliding off all loops of the pins along the one side of the hexagon. After that, it is easy to lift off the rest of a hexagon with fingers. For looms 12 with headless pins, this step is simply to slide off the hexagon woven fabric 40 from loom 12.

The novel method of the present disclosure then entails pulling opposite corners and sides of the hexagon weave pattern and wiggling them a bit to even out the fabric. At that point, the hexagons are ready to be used, all ends are locked and will not unravel. For making a wide variety of items, many such hexagon weave patterns may be used.

The presently disclosed subject matter may be used easily by both right- and left-handed users. The weaving instructions are in large identical for left-handed and right-handed users. Attention is needed, however, when weaving the first part of the hexagon using the bias method.

A few simple rules pertaining to the right-handed or left-handed user apply. So, instead of "clockwise,' the left-handed user will work "counterclockwise." This involves starting, as usual, at the top white pin, but when guiding the yarn to the bottom white pin, go around the pin from the "left to right," or counterclockwise. This process calls for guiding the yarn back to the top, to the first round pin on the "right" of the white pin and going around back from the right to the left, or counterclockwise. The process, then continues working counterclockwise, always working around the next available brown pin. In addition, for the left-handed weaver, at the end of the bias weaving section, the yarn will come out at the "right" bottom black pin. From there, the process includes wrapping the yarn "counterclockwise" around the hexagon to measure the length of the yarn required to weave the middle section of the hexagon.

Figure 23:
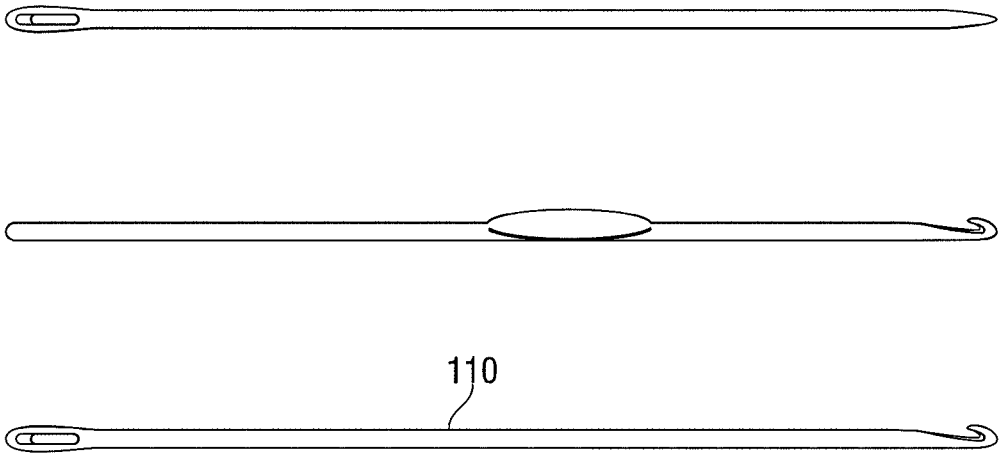
FIG. 23 illustrates alternative embodiments of weaving needles and rocker hooks for use with the presently disclosed embodiments.

FIG. 23 illustrates an alternative embodiment of the rocker hook 14 and weaving needle 16 of FIG. 1. Here, dual end locker hook 110 provides. An advantage of the locker hook is that it is a single tool that provides the functions of both the crochet book and the weaving needle. In addition, the locker hook may be preferred when particular types of yarn, for example mohair, is used because of its ability to operate more easily with these types of yarns.

Figure 24:
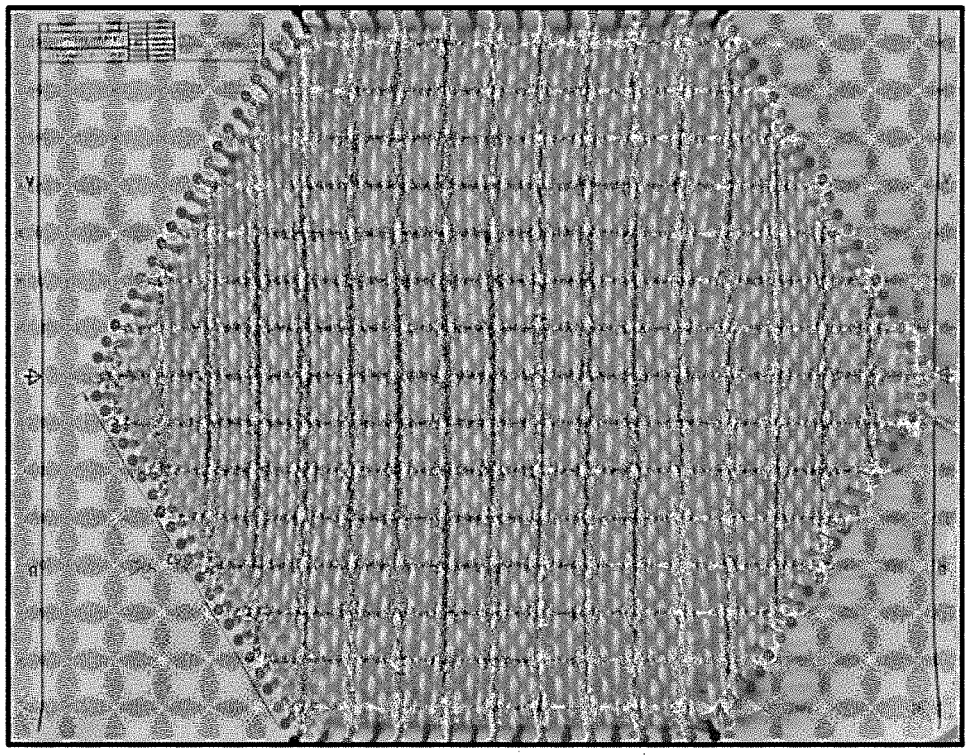
FIG. 24 shows a continuous strand hexagon woven fabric using large embodiment of the present disclosure.

FIG. 24 shows a continuous strand hexagon woven fabric 112 using large embodiment of the present disclosure.

Figure 25:
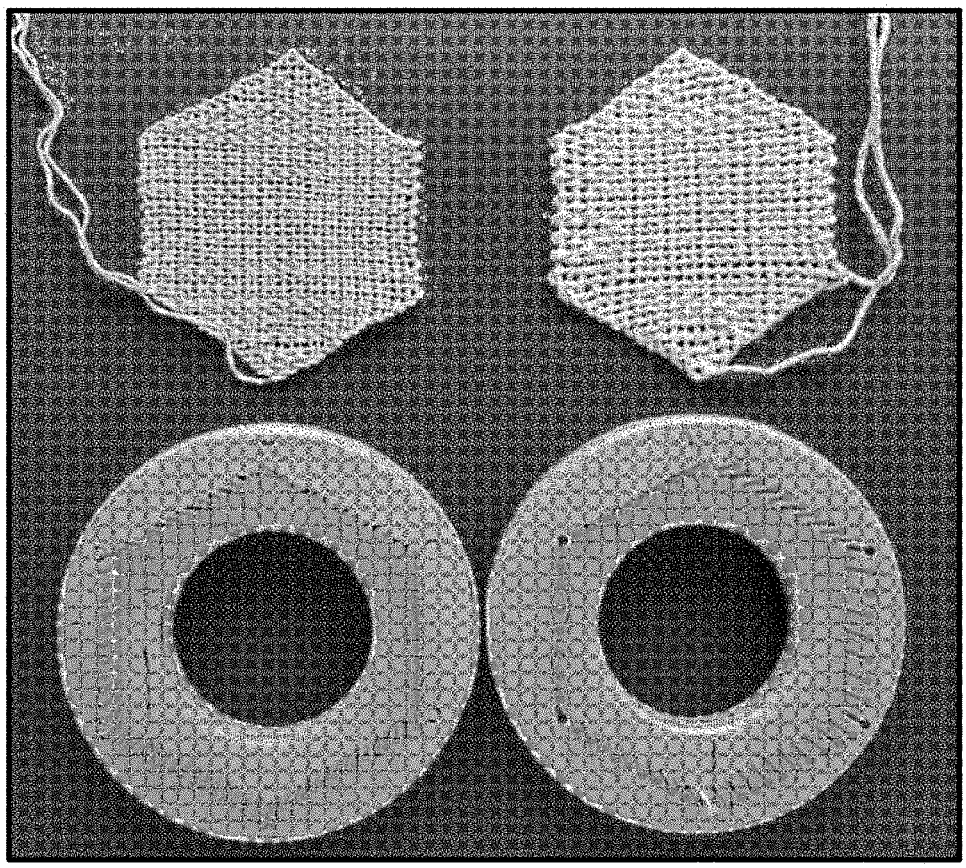
FIG. 25 shows alternative embodiments of continuous strand weaving hexagon pin looms and their differing woven fabric results.

FIG. 25 shows alternative embodiments of continuous strand weaving hexagon pin looms and their differing woven fabric results. In some embodiments, in contrast to using black, white, and brown pin colors to guide the weaving process, other ways of marking are possible. For example, the alternative loom of FIG. 25 shows the use of "hexagons" and "O"'s to identify the importance of the loom for performing the weaving process. In yet another alternative embodiment, pins without heads may be used for holding the yarn. Thus, the pins for loom 12 may have heads on them or be headless according to the desire of the user in manufacture. The headless pins also appear in FIG. 25.

Alternative embodiments of the present process include weaving additional rows when using thinner worsted weight yarns. The recommended yarn is "worsted" weight yarn, and the presently disclosed loom has successfully woven a large variety of materials, including acrylics, blends, cotton, wool, rayon, silk materials that are fuzzy, shiny, nubby, marled, store-bought, even hand spun. The best way to determine whether a yarn will work is to weave a sample hexagon.

However, even with the "worsted" category, some yarns are better than others. If the user works with a "thinner" worsted weight yarn and notices that the fabric weaves is just a little bit too loosely, the user can easily weave two or any multiple of two extra rows in the middle section of the hexagon to improve the density of the fabric.

There are many choices in yarns that a weaver may use to practice the presently disclose subject matter. Every yarn is not perfect for every project. So, properly selecting a yarn weight will allow significantly more creativity in choices of the appropriate yarn. The standard yarn weight system provides yarn weights by referring to the thickness of the yarn.

Yarn thicknesses may range from super fine to super bulky. Seven different standard categories of yarn weights, established by the Craft Yarn Council, assign specific weights of yarn according to how a yarn produces a somewhat predictable number of stitches when using a particular sized needle. The higher the number, the heavier the yarn and the fewer stitches per inch the weaver will get but ply doesn't always correlate to the weight of a yarn.

Standards matter because, if the weaver knows that every bulky yarn is going to give around the same number of stitches (e.g., 12 to 15 stitches in four inches on size 9 to 11 needles) and he uses a pattern with bulky yarn and size 10 needles, he can use any kind of bulky yarn and get a similar result.

Most yarn manufacturers make it easy to determine the weight of a particular yarn. Many mass-produced yarns use the yarn standards ranking system and will have the number and weight printed right on the label. Other manufacturers don't make it as easy but will say something like "24 stitches and 22 rows per four inches on size 4 needles."

In various embodiments of the present disclosure, uses may include weight 1-2 for "fine sett," 4 for the original pin spacing, and 5-6 for the "bulky sett." Weight 3 can be accommodated by weaving extra rows and/or starting with a loop instead of a single string, as described above.

Figure 26:
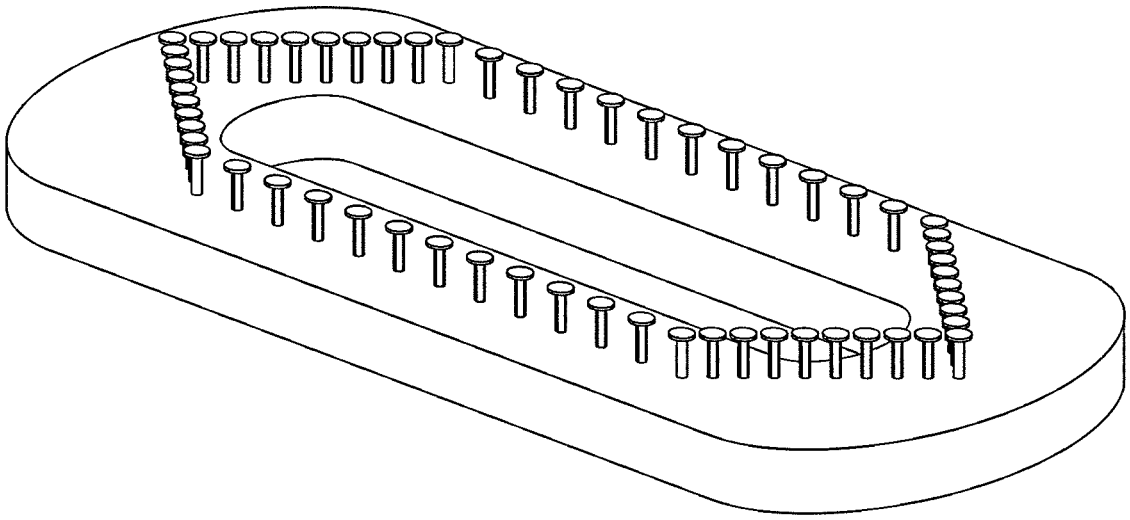
FIG. 26 illustrates an elongated continuous strand weaving pin loom within the scope of the present disclosure.
Figure 27:
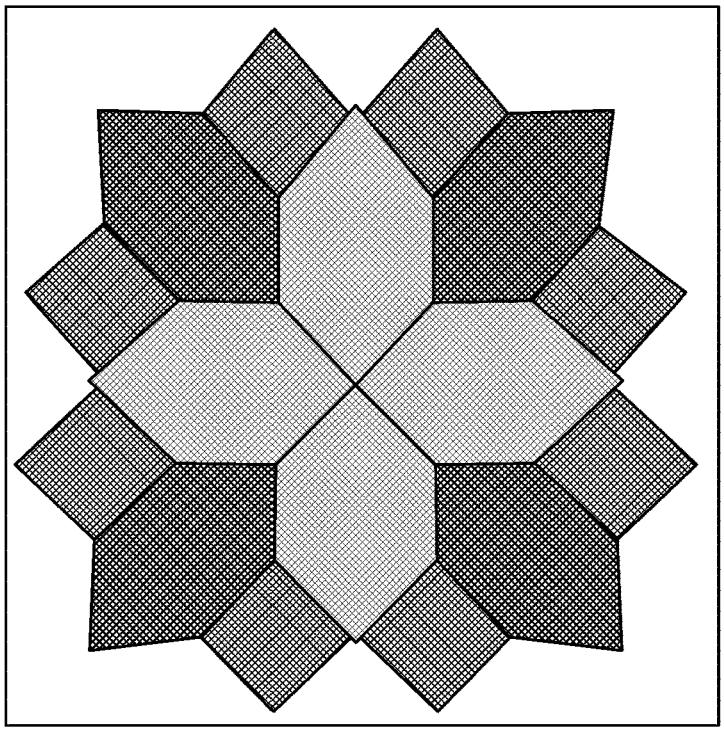
FIG. 27 through 32 show various attractive items that may be formed using the presently disclosed continuous strand weaving pin loom.
Figure 28:
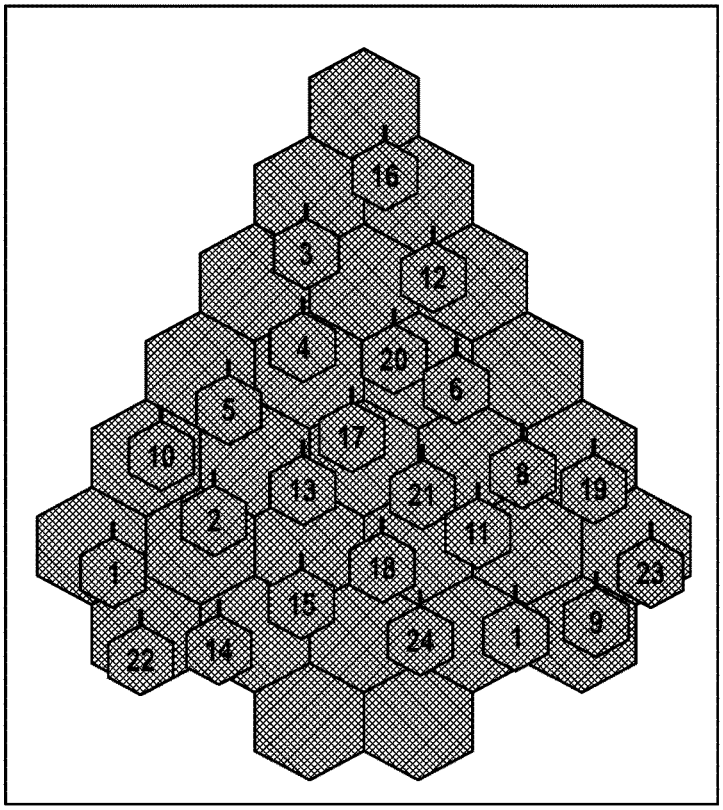
Figure 29:
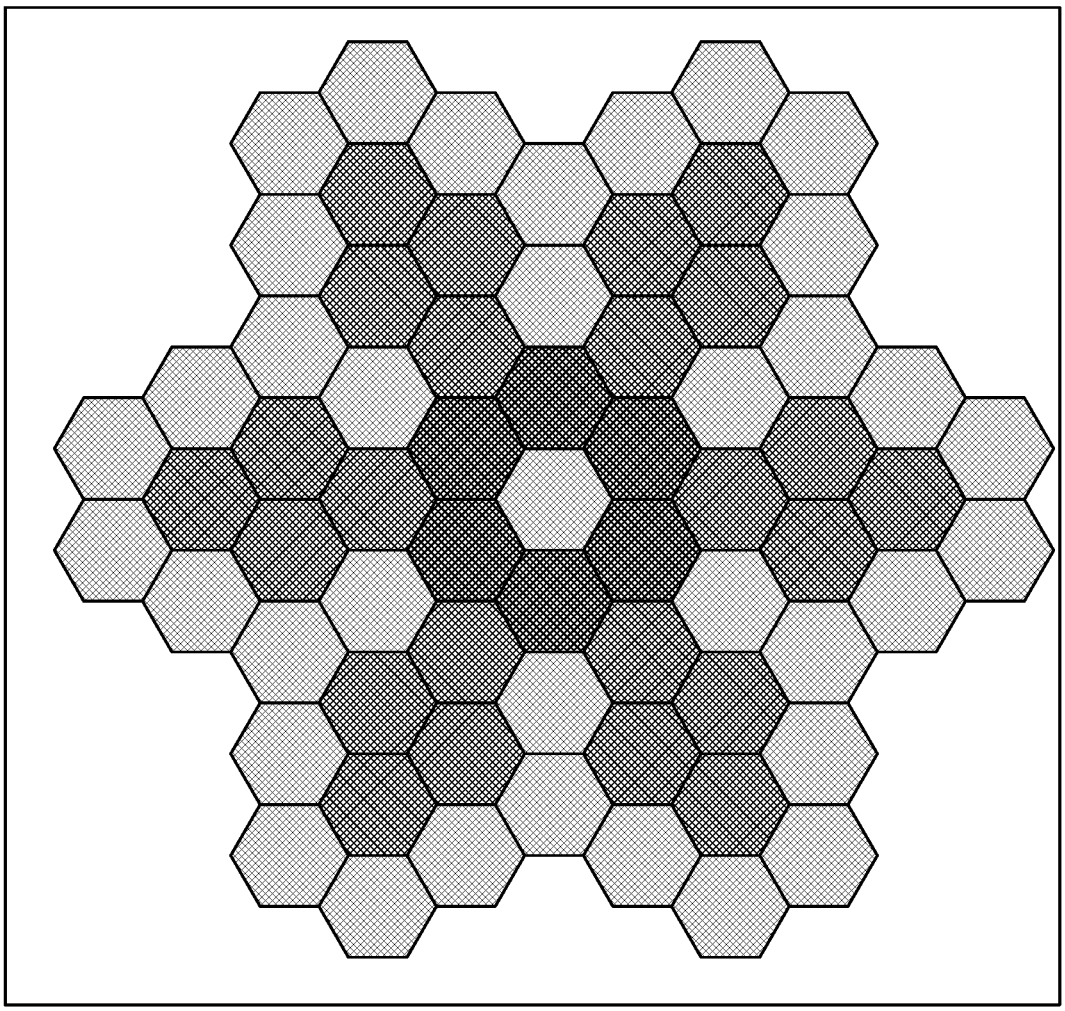
Figure 30:
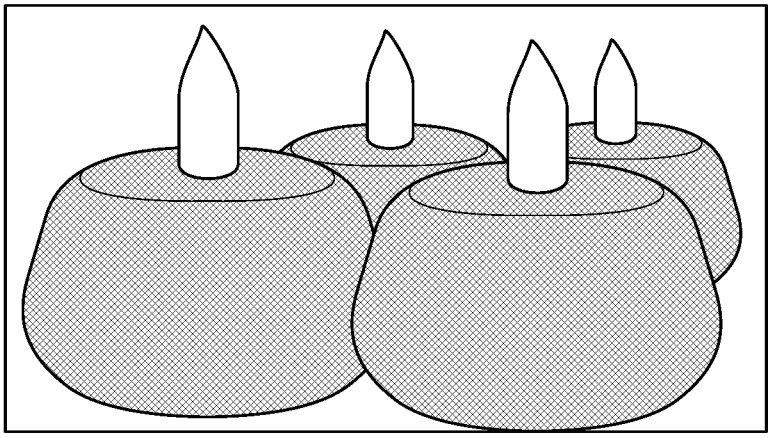
Figure 31:
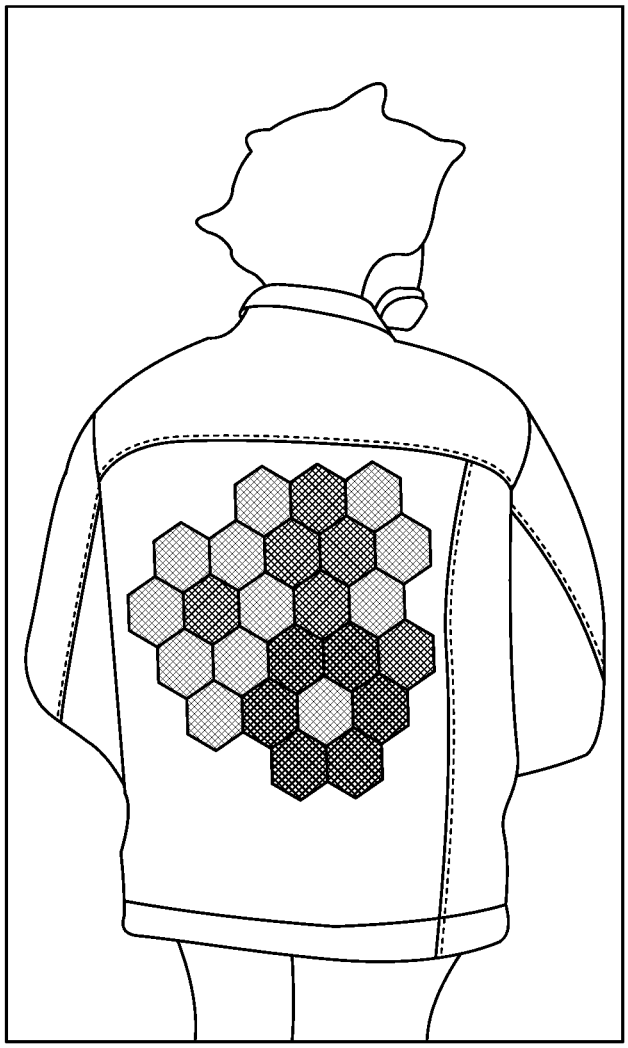
Figure 32:
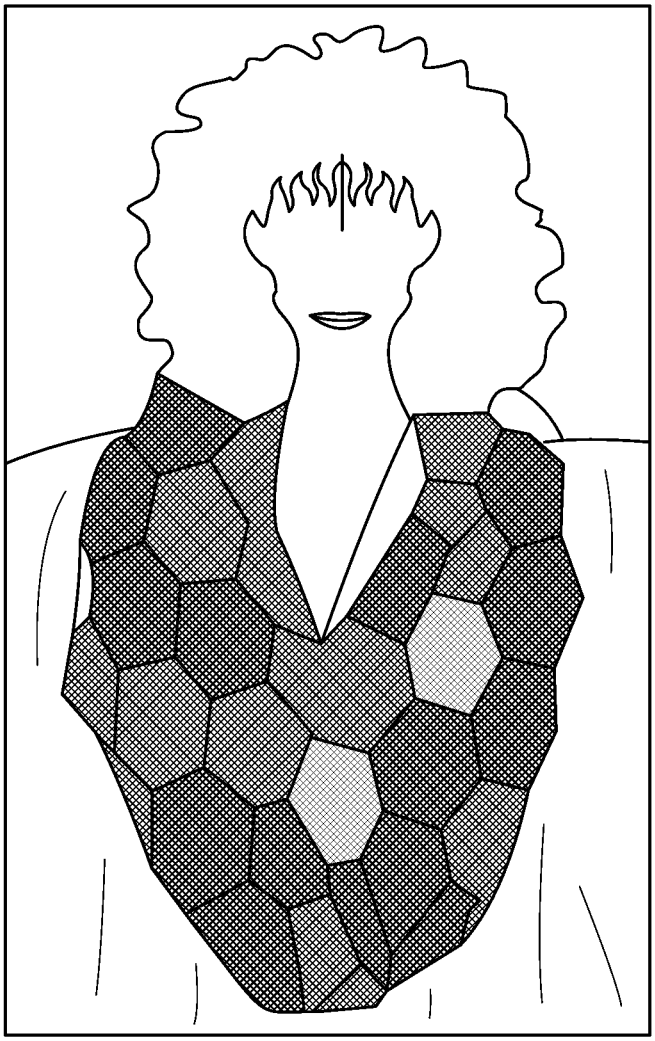

FIG. 26 illustrates an elongated continuous strand weaving pin loom within the scope of the present disclosure; and FIGS. 27 through 32 show various attractive items that may be formed using the presently disclosed continuous strand weaving pin loom.

Figure 33:
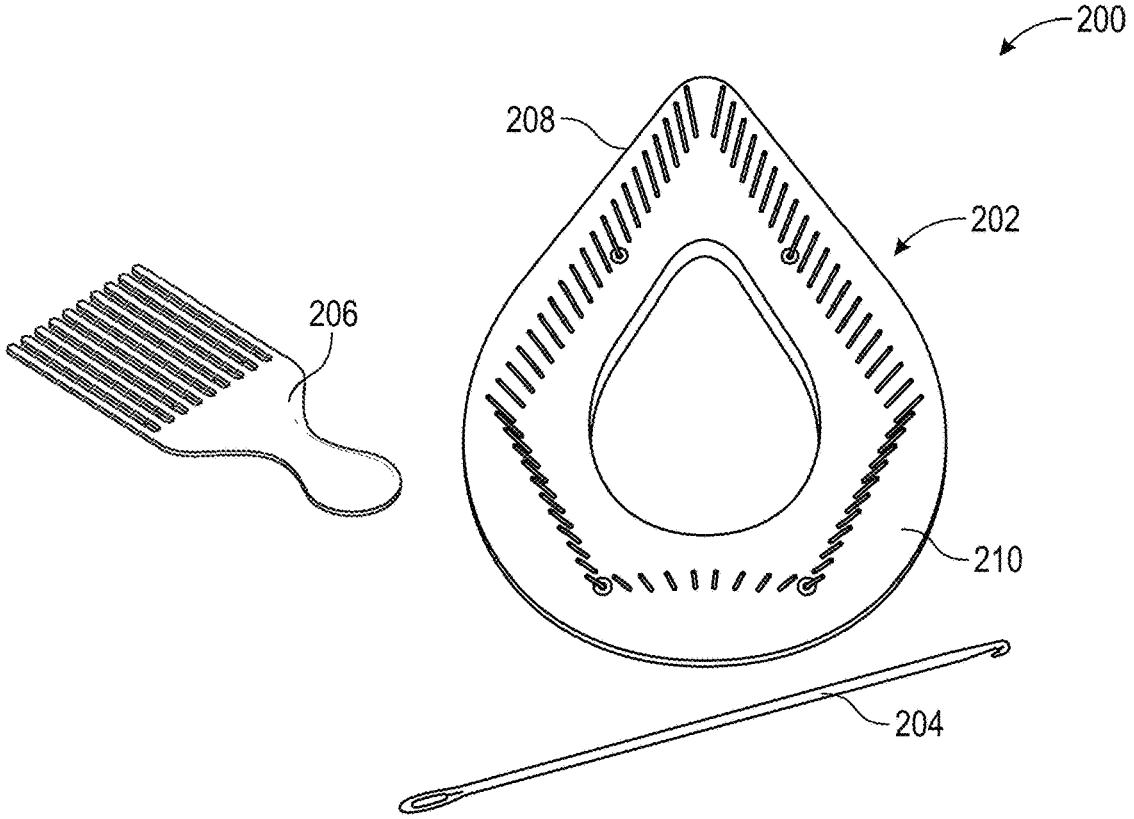
FIG. 33 shows the components of a kit including the continuous strand weaving pin loom having a pentagonal pattern, of the present disclosure.
Figure 34:
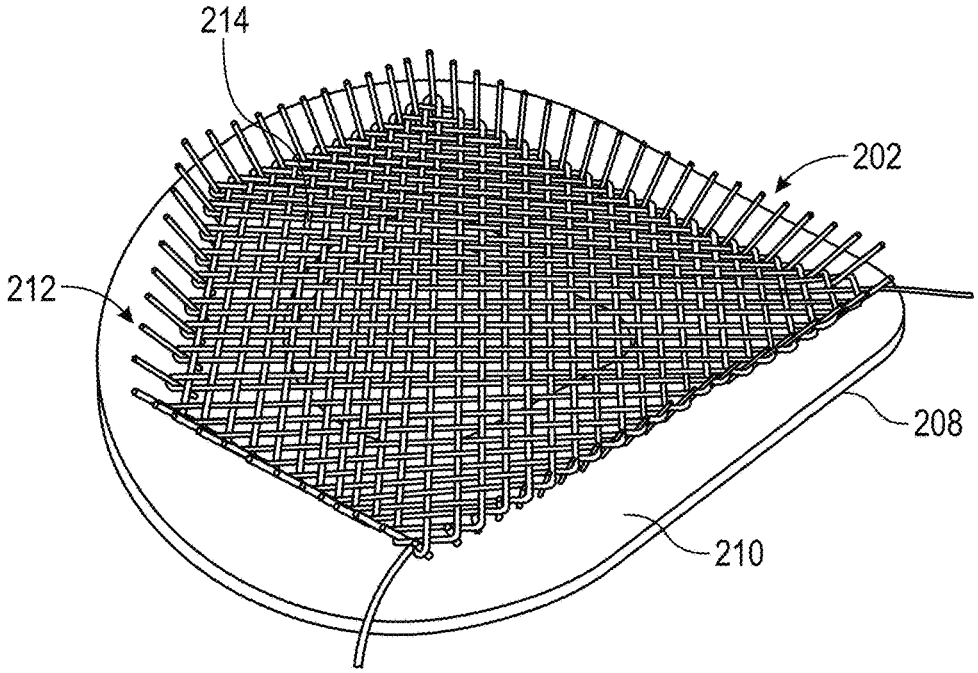
FIG. 34 shows a pentagonal pin loom having a continuous strand pentagon woven fabric, according to the present disclosure.
Figure 35:
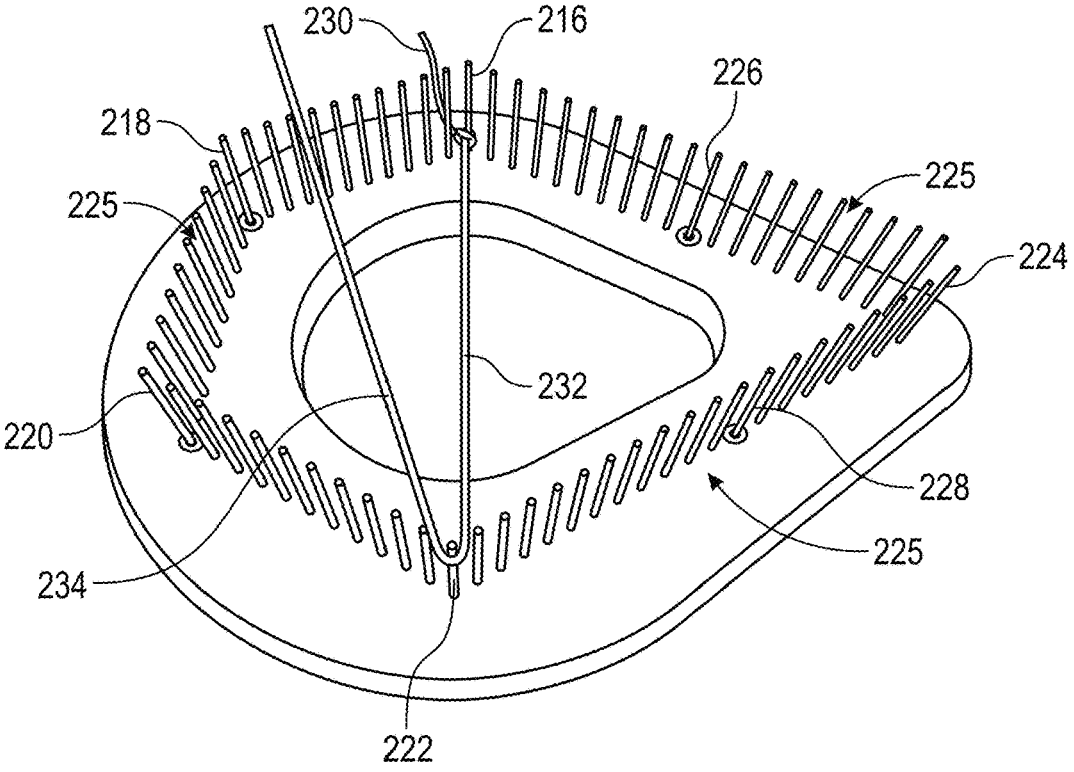
FIGS. 35 through 47 depict various aspects of methods for using the presently disclosed continuous strand weaving pin looms having a pentagonal pattern.

FIG. 33 shows a continuous strand weaving pin loom kit or a turtle loom kit 200, in accordance with one embodiment of the present invention. Turtle loom kit 200 includes a turtle loom or loom 202, a locker hook 204, and a packing comb 206. Turtle loom 202 includes a loom frame 208 having a surface 210. As can be seen, loom frame 208 comes in the shape of a pentagon configuration. Loom frame 208 includes pins 212 vertically positioned in a predetermined pentagonal arrangement, as shown in FIGS. 34 and 35. Pins 212 allow to construct a pentagonal woven fabric 214, as shown in FIG. 34, for example. In the present disclosure, locker hook 204 permits manipulation of strands from which turtle loom 202 constructs the pentagonal woven fabric 214. In addition to the tools that come with kit 200, there is the need for the user or weaver to have yarn for making pentagonal woven fabric 214. In general, any worsted weight yarn may be used (for the standard spaced looms). There is a broad spectrum of yarns that can be used with the presently disclosed turtle loom 202.

Now referring to FIG. 35, arrangement of pins 212 and initial steps in the sequence of the weaving process is shown. For ease of reference, pins 212 positioned at the edges or corners of the pentagonal arrangement or pentagonal pattern are referred to as a first pin 216, a second pin 218, a third pin 220, a fourth pin 222, and a fifth pin 224. Fifth pin 224 refers to one or two pins 224 at the tip or end of loom frame 208. Further, pins 212 arranged in between each of first pin 216, second pin 218, third pin 220, fourth pin 222, and fifth pin 224 are referred as center pins 225 (also referred as brown pins or colored pins 225). Additionally, a pin 225 between first pin 216 and fifth pin 224 is selected as a sixth pin 226. A person skilled in the art understands that any center pin 225 between first pin 216 and fifth pin 224 can be selected as sixth pin 226. Further, a pin 225 between fourth pin 222 and fifth pin 224 is selected as a seventh pin 228. A person skilled in the art understands that any center pin 225 between fourth pin 222 and fifth pin 224 can be selected as seventh pin 228. In one example, center pins 225 that are positioned at ninth ($9^{th}$) place from fifth pin 224 are selected as sixth pin 226 and seventh pin 228. However, any pins 225 that are parallel to and facing each other can be selected as sixth pin 226 and seventh pin 228, depending on the size/sett of turtle loom 202. Sixth pin 226 and seventh pin 228 are selected such that they are opposite and aligned with each other and form a hexagonal configuration with first pin 216, second pin 218, third pin 220, and fourth pin 222, and form a substantial triangular configuration with fifth pin 224 (i.e., sixth pin 226, seventh pin 228 and fifth pin 224). In other words, first pin 216, second pin 218, third pin 220, fourth pin 222, sixth pin 226 and seventh pin 228 form a hexagonal configuration. Further, fifth pin 224, sixth pin 226 and seventh pin 228 form a triangular configuration. A person skilled in the art understands that sixth pin 226 and seventh pin 228 are referenced in the present disclosure for ease of explaining the hexagonal continuous strand formation and completion of triangular section of pentagonal strand woven fabric.

FIG. 35 shows the initial steps in the sequence of the weaving process. The weaving process begins with forming of a continuous yarn strand 230 with a slip knot. At first, yarn strand 230 is connected (knot) over first pin 216 (starting pin). First pin 216 helps the user to get started in the bias weaving process. Yarn strand 230 is pulled down to become warp strand 232.

Figure 36:
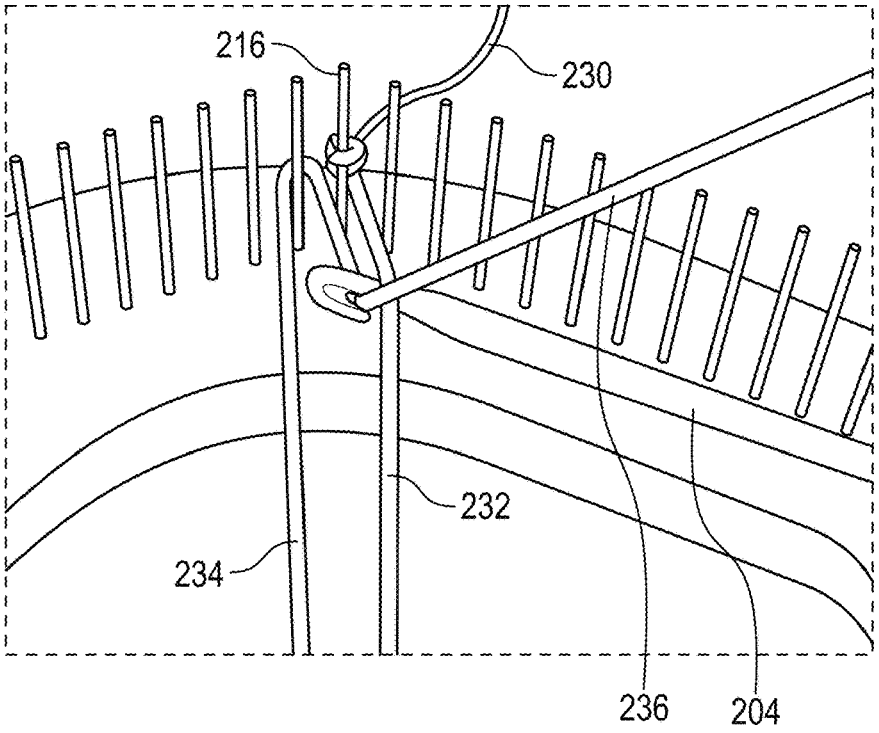
Figure 37:
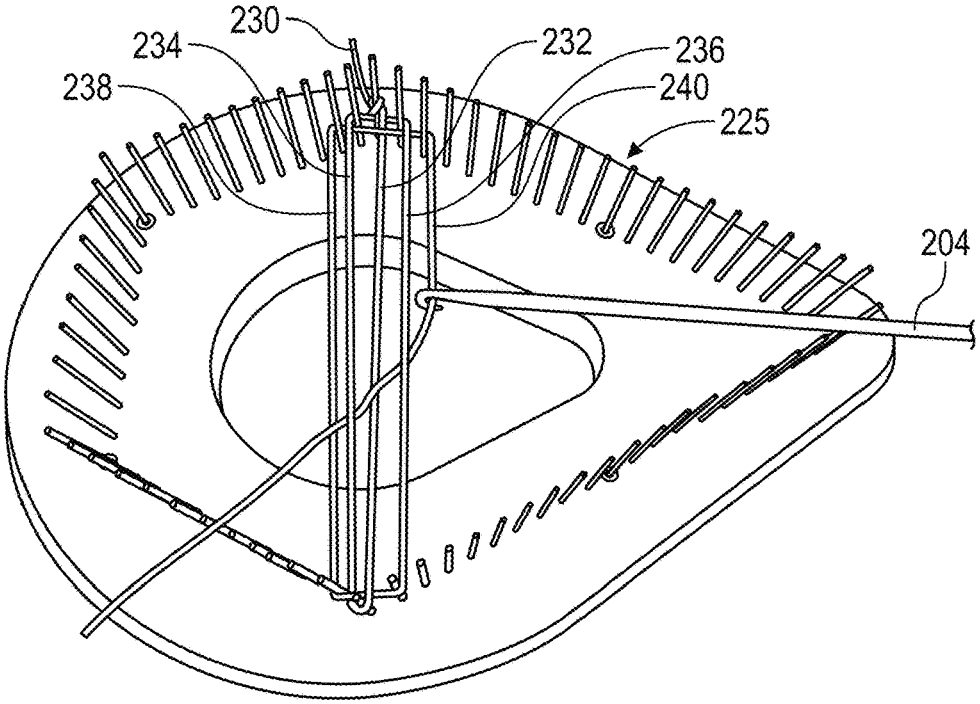
Figure 38:
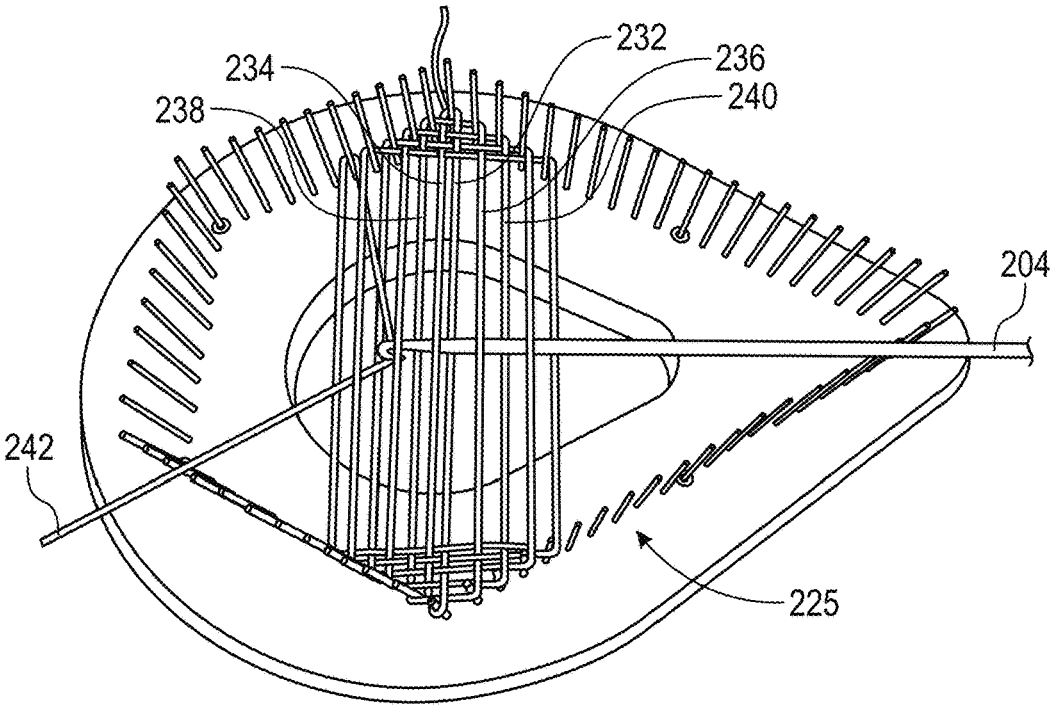

The user takes yarn strand 230 around fourth pin 222 from the right to the left and then backs up forming warp strand 234. The weaving process continues in a clockwise fashion. The user returns to the top of turtle loom 202 (towards first pin 216), where warp strand 234 is threaded from the left to the right around center pin 225 adjacent to first pin 216 at the top angle of loom pin arrangement. FIG. 36 shows the user bringing warp strand 236 to be pulled under warp strand 232. Warp strand 236 is taken over center pin 225 to the right of first pin 216. The workings of thread slides down to duplicate the weave down to the bottom triangle of the pentagonal. Warp strand 236 is guided around the center pin 225 to the right of fourth pin 222. Warp strand 238 comes out to the left and weaves the first row of what will become the bottom triangle woven fabric segment. FIG. 37 shows the step of the process of taking warp strand 238 to the next center pin 225 on the left side of fourth pin 222. The user guides warp strand 238 to the next available center pin 225 on the left at the top. Then, the user guides warp strand 240 under warp strand 234, over warp strand 232 and under warp strand 236 using locker hook 204. Warp strand 240 goes around center pin 225 and the user guides warp strand 240 over the next available center pin 225 to the right of fourth pin 222 and continues the weaving process. The user repeats the above steps, clockwise, and always uses the next available pin to guide the yarn around. After 4-6 rounds, the yarn goes across (weft) and builds little "arches", indicating a perfect tension. The arches indicate a proper tension in the woven fabric. FIG. 38 shows the next step in the weaving process using locker hook 204 used to weave warp strand 242 depending on the need.

Figure 43:
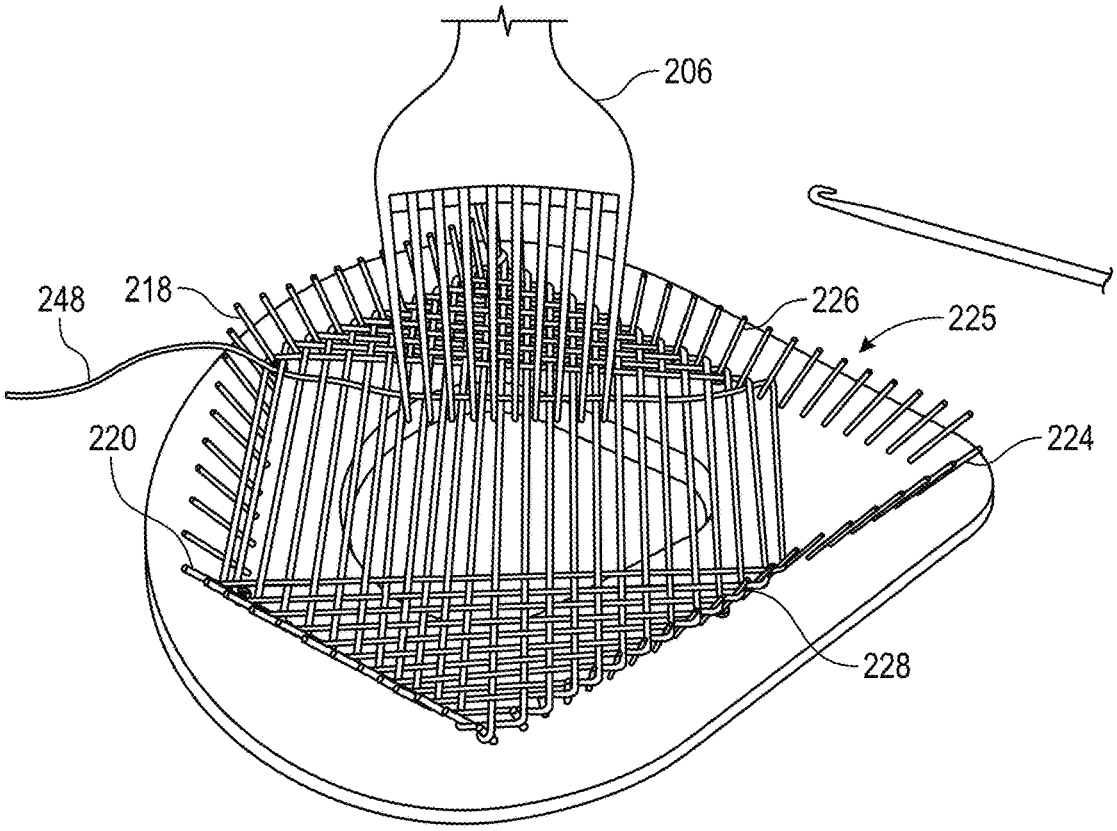

The user weaves at the top and then guides the working thread down to the bottom which automatically performs the placement in the bottom. This continues until the completion of a top woven triangle fabric section and a bottom woven triangle fabric section. At this point, the horizontal yarn threads may show small arches within the weave. The arches indicate a proper tension in the woven fabric. In order to remove the arches, which is desirable for the construction of the pentagonal woven fabric, packing comb 206 (as shown in FIG. 43, for example) may be used to straighten those arched threads. The arches (i.e., "Pack" or "beat") are put down with packing comb 206 or the end of the weaving tool to straighten the rows. From here on, every pack once every round or as needed is put down to achieve the best results. The bias weaving method continues until second pin 218, third pin 220, sixth pin 226 and seventh pin 228 are covered with the yarn and the working thread comes out at third pin 220.

Figure 39:
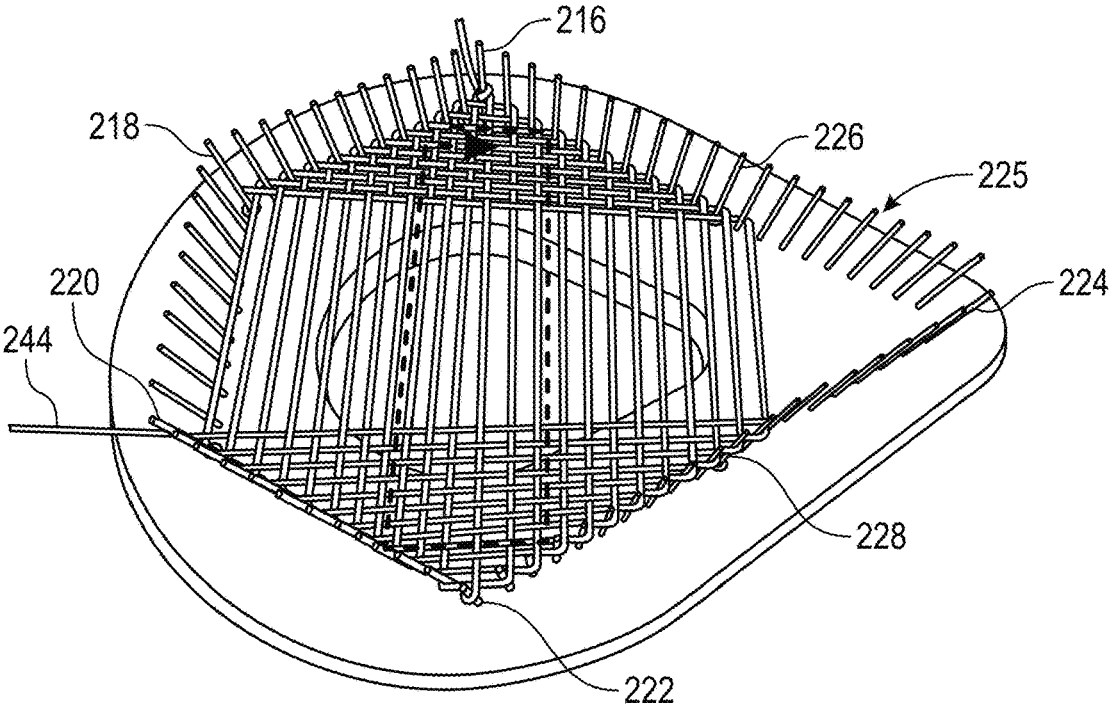

At the end, woven triangles at the top and the bottom are formed, and the center section is filled with "warping" threads, as shown in FIG. 39, for example. After finishing the continuous strand weaving, the working yarn 244 is at the bottom left corner, as shown in FIG. 39. At this point, all center pins 225 should have yarn around them at the bottom and top triangles. Yarn 244 covers pins 225 above second pin 218 and sixth pin 226 in the top angled side of hexagonal configuration. Yarn 244 covers all pins 225 below third pin 220 and seventh pin 228 in the bottom angled side of the hexagonal configuration. This shows a triangle weave configuration at the top and the bottom portions of the woven fabric 214.

In order to fill the center section or middle section with the "warping" threads, along with the remaining portion between sixth pin 226, seventh pin 228 and fifth pin 224, the continuous strand method used to weave triangles is furthered or continued. Here, yarn 244 advances "in U-shapes".

Figure 40:
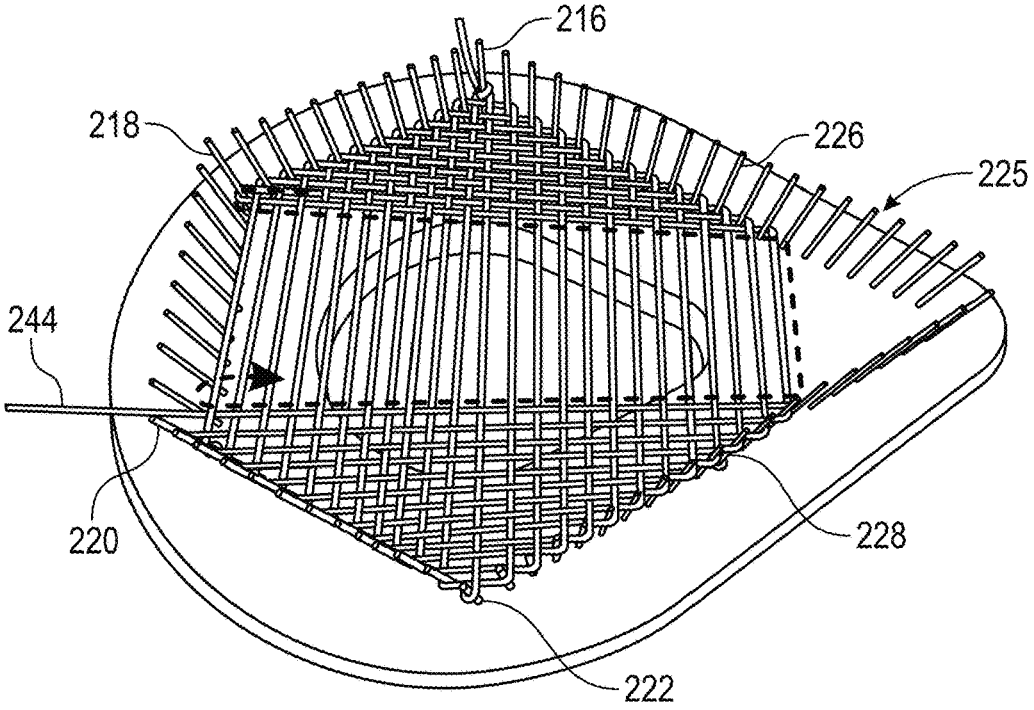

Here, the user advances yarn 244 "in U-shapes", as shown in FIG. 40. FIG. 39 shows the proper motion of the weaving thread, in rounds, for the first part of weaving. FIG. 40 shows the proper motion of the weaving thread, in U-shapes, for the second part of weaving the pentagon.

Figure 41:
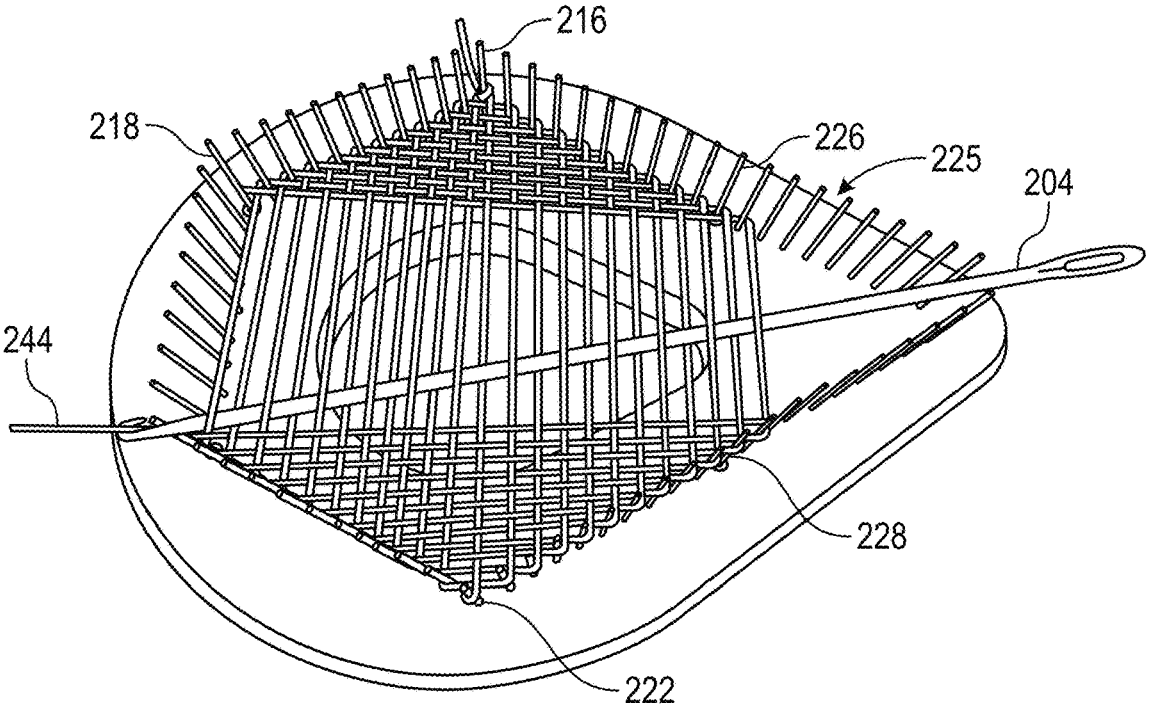
Figure 42:
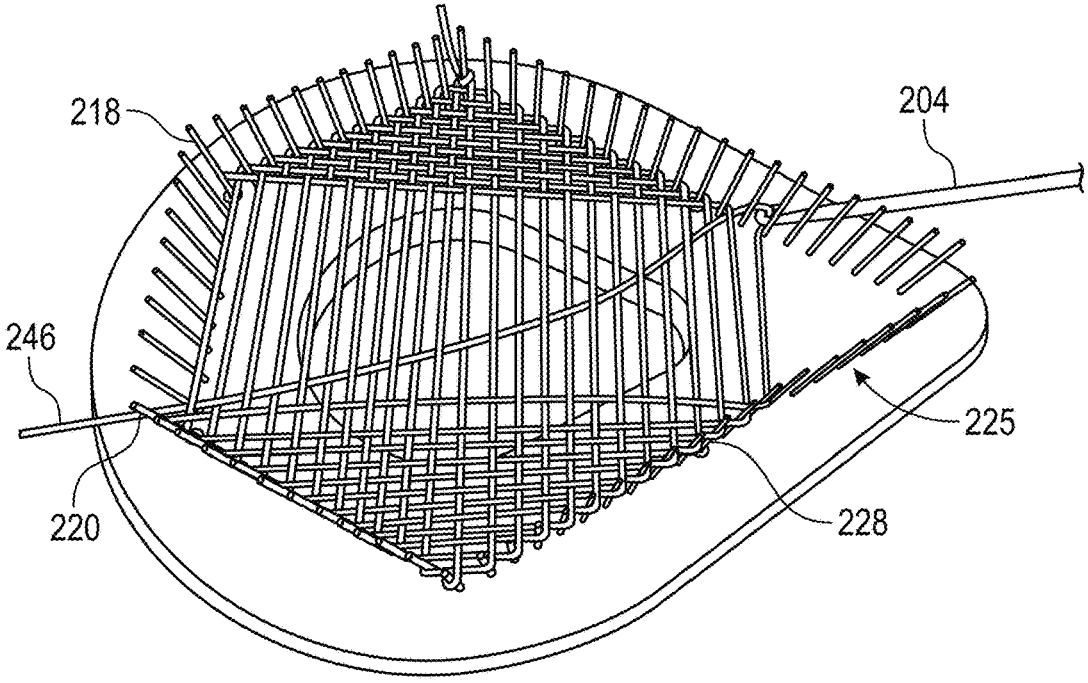
Figure 44:
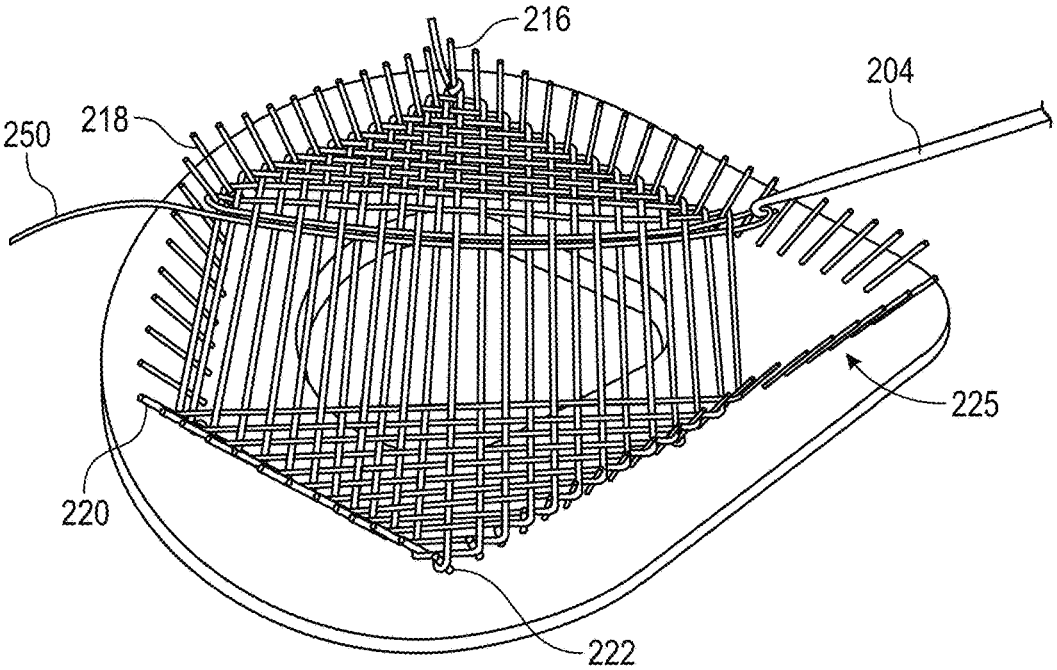

Further, rocker hook 204 is weaved from the right to the left, towards the space between the bottom corner (i.e., third pin 220) and the next pin (i.e., seventh pin 228), near the working yarn. Here, the open space at the right tip is used to easily move rocker hook 204 where it needs to go, as shown in FIG. 41. Yarn 244 is fetched, pulled through and guided over the next available pin 225 at the bottom right of seventh pin 228. Further, working yarn 246 is picked up on the inside weaving area and guided to the top right of next available pin 225 (adjacent to sixth pin 226), as shown in FIG. 42. Further, the working yarn 248 is guided on the left side between the next two open spaces at the top left. For best result, packing comb 206 is used to pack the yarn/strands when needed, as shown in FIG. 43. Rocker hook 204 is weaved from right to the left, towards the space between the top corner and the next pin, near the working yarn. Here, yarn 250 is pulled through and guided over the next available pin 225 at the top right, as shown in FIG. 44.

Figure 45:
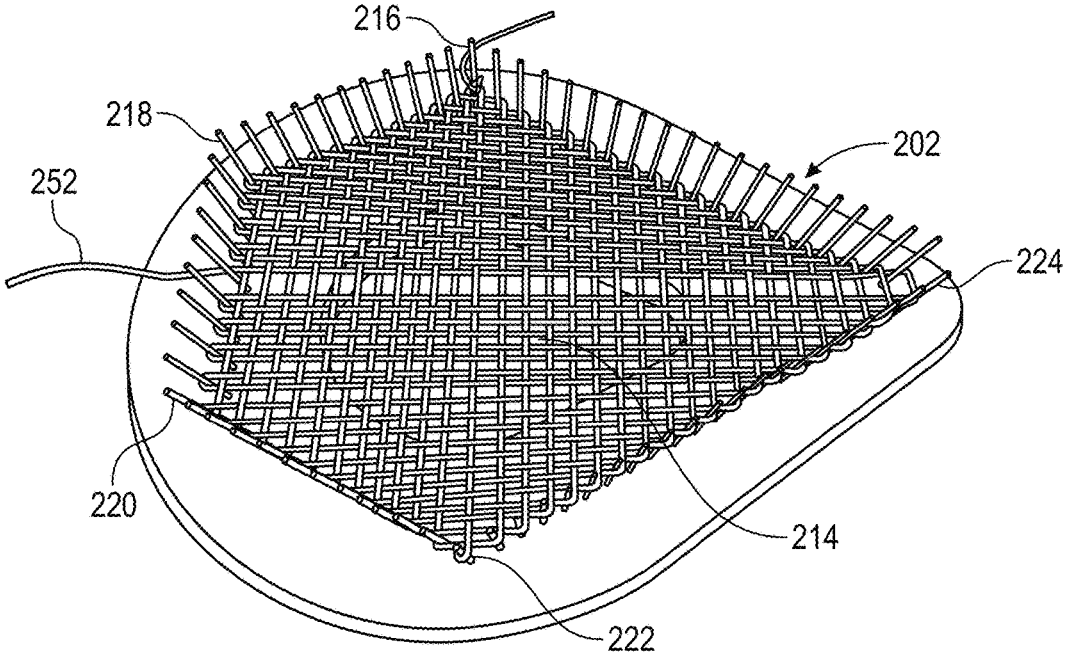
Figure 46:
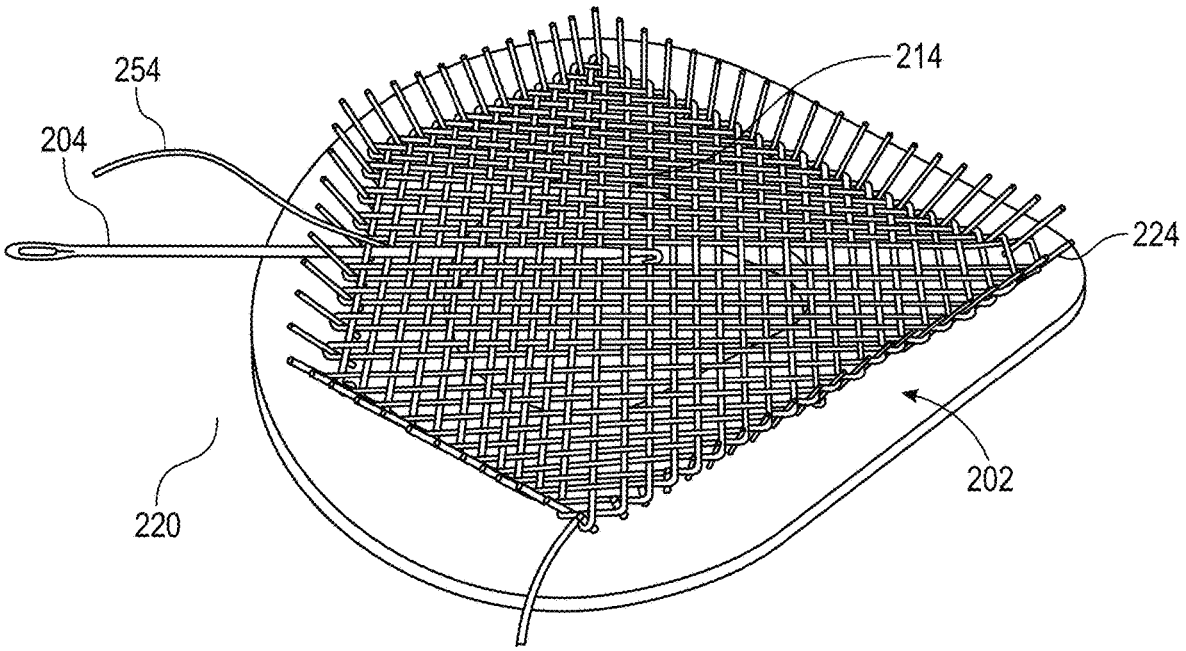

The weaving continues until all center pins 225 toward fifth pin 224 i.e., the tip on the right of pins 212 are covered, as shown in FIG. 45. As can be seen, there is only one pin between second pin 218 and third pin 220 (and two pins 225 facing each other close to fifth pin 224) on the left straight side near working yarn 252 without yarn wrapped around it. In order to prepare for the last row of weaving, the user measures one wrap of yarn 252 around pins 212 and cuts yarn 252. Subsequently, yarn end is threaded through the eye of rocker hook 204. Here, turtle loom 202 is turned and rocker hook 204 is used as a needle to weave the last row, around the last pin between second pin 218 and third pin 220 on the straight side towards the tip i.e., fifth pin 224 of turtle loom 202, as shown in FIG. 46. Further, yarn 254 is pulled through. If needed, packing comb 206 is used to stroke the weaving so that the threads are evenly spread out.

Figure 47:
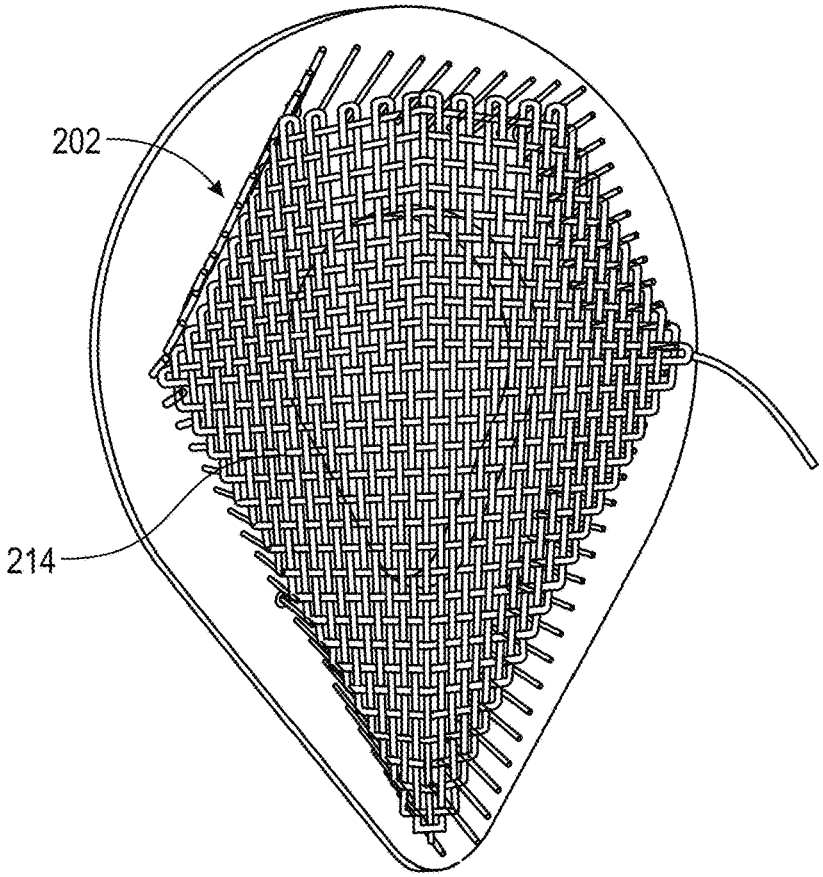

After completion of the weaving, completed pentagonal woven fabric 214 is taken off from turtle loom 202. In order to take pentagonal woven fabric 214 off turtle loom 202, turtle loom 202 is turned and pentagonal woven fabric 214 is pushed off pins 212, as shown in FIG. 47. The opposite sides of pentagonal woven fabric 214 is pulled and wiggled to even out pentagonal woven fabric 214. Further, all ends of yarns are locked so that they do not unravel.

Figure 48:
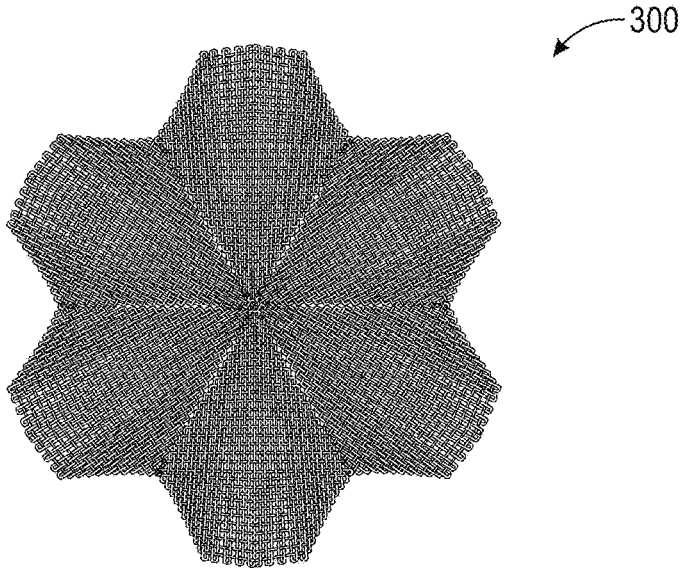
FIG. 48 shows an attractive item that is formed using the presently disclosed continuous strand weaving pin loom having the pentagonal pattern.

Multiple pentagonal woven fabrics 214 can be combined to form an attractive item. FIG. 48 shows an attractive item 300 formed using the presently disclosed continuous strand weaving method. If needed, the density of pentagonal woven fabric 214 is adjusted for a certain yarn. The density can be achieved by double-weaving or by omitting pins.

The presently disclosed subject matter may be used easily by both right- and left-handed users. The weaving instructions are in large identical for left-handed and right-handed users. A few simple rules pertaining to the right-handed or left-handed user apply. In other words, for a right handed weaver, the tip of the pentagon loom points to the right such that when using the pentagon loom that at the beginning of the weaving the "tip" of the pentagon points into the direction of the weaving hand. Further, for a left handed weaver, the tip of the pentagon loom at the beginning of weaving points to the left. Instead of "clockwise,' the left-handed user will work "counterclockwise." This involves starting, as usual, at first pin 216, but when guiding the yarn to fourth pin 222, go around fourth pin 222 from the "left to right," or counterclockwise. This process calls for guiding the yarn back to the top, to the first pin on the "right" of the fourth pin 222 and going around back from the right to the left, or counterclockwise. The process, then continues working counterclockwise, always working around the next available pin 225. In addition, for the left-handed weaver, at the end of the bias weaving section, the yarn will come out at the "right" bottom pin (seventh pin 228). From there, the "U-shaped" weaving works identical for left and right handed users.

Strands may be added or subtracted during the weaving process. In order to add a round, the next round is weaved, putting the yarn around the same pins of the previous round. In order to subtract or reduce a round, a pin is skipped on each side.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

The benefits and advantages that may be provided by the present invention has been described above regarding specific embodiments. These benefits and advantages, and any elements or limitations that may cause them to occur or to become more pronounced are not to be construed as critical, required, or essential features of any of any or all of the claims. As used herein, the singular forms "a", "an", and "the" are intended to include the plural forms as well, unless the context clearly indicates otherwise. It is further understood that the terms "comprises" and/or "comprising" or "includes" and/or including", or any other variation thereof, are intended to be interpreted as nonexclusively including the elements or limitations which follow those terms. Accordingly, a system, method, or other embodiment that comprises a set of elements is not limited to only those elements, and may include other elements not expressly listed or inherent to the claimed embodiment. These terms when used in this specification, specify the presence of stated features, regions, integers, steps, operations, elements, and/or components, but do not preclude the presence or addition of one or more features, regions, integers, steps, operations, elements, components, and/or groups thereof.

What is claimed is:

1. A method for forming a pentagonal woven fabric, said method comprising the steps of:

providing a single continuous yarn strand for forming said pentagonal woven fabric;

providing a pentagonal pattern loom, comprising:

a loom frame;

a plurality of loom pins perpendicularly embedded into said loom frame and protruding at a predetermined distance for engaging and holding said single continuous yarn strand, said plurality of loom pins arranged in a pentagonal pattern forming a structure for engaging said single continuous yarn strand, said loom pins comprising a first pin, a second pin, a third pin, a fourth pin, and a fifth pin positioned at the edges of said pentagonal pattern with center pins therebetween, wherein said first pin, said second pin, said third pin, and said fourth pin forming a hexagonal configuration, wherein at least two of said center pins are between said first pin and said fifth pin and at least two of said center pins are between said fourth pin and said fifth pin, said hexagonal configuration having:

a first predetermined subset of said loom pins forming a top angled side of said hexagonal configuration;

a second predetermined subset of said loom pins forming a bottom angled side of said hexagonal configuration; and a third predetermined subset of said loom pins forming two opposite straight sides of said hexagonal configuration, said two opposite straight sides connecting to said top angled side and said bottom angled side forming a loom pins spacing for said hexagonal configuration;

at least two of said center pins between said first pin and said fifth pin and at least two of said center pins between said fourth pin and said fifth pin forming a triangular configuration;

bias weaving using said single continuous yarn strand for forming a top woven triangle fabric section, a bottom woven triangle fabric section, and a middle section of parallel yarn strand portions of said single continuous yarn strand, said middle section forming a plurality of weaving warps for continuing to weave using said single continuous yarn strand;

a continuous weaving using said single continuous yarn strand as weft strands in said middle section of parallel yarn strand portions for forming a rectangular woven fabric section with remaining loom pins in said triangular configuration of said pentagonal pattern, wherein upon completing said continuous weaving step, said top woven triangle fabric section, said bottom woven triangle fabric section, and said rectangular woven fabric section form a pentagonal woven fabric element using the single continuous yarn strand; and separating said pentagonal woven fabric element from said pentagonal pattern loom.

2. The method of claim 1, further comprising a step of beginning said bias weaving step by tying said single continuous yarn strand to a predetermined top loom pin.

3. The method of claim 1, further comprising measuring one wrap of said single continuous yarn strand around at least one of said loom pins for weaving said single continuous yarn strand through said rectangular woven fabric section in said triangular configuration of said pentagonal pattern.

4. The method of claim 1, further comprising advancing said continuous yarn strand in a U-shape configuration in said rectangular woven fabric section.

5. A method for forming a craft item comprising the steps of:

using a plurality of interconnected pentagonal woven fabric segments placed adjacent to one another, each pentagonal woven fabric segment of said plurality of interconnected pentagonal woven fabric segments is formed by performing the steps of:

providing a single continuous yarn strand for forming said pentagonal woven fabric segment;

providing a pentagonal pattern loom comprising:

a loom frame;

a plurality of loom pins perpendicularly embedded into said loom frame and protruding at a predetermined distance for engaging and holding said single continuous yarn strand, said plurality of loom pins arranged in a pentagonal pattern forming a structure for engaging said single continuous yarn strand, said loom pins comprising a first pin, a second pin, a third pin, a fourth pin, and a fifth pin positioned at the edges of said pentagonal pattern with center pins therebetween, said first pin, said second pin, said third pin, and said fourth pin forming a hexagonal configuration, at least two of said center pins positioned between said first pin and said fifth pin and at least two of said center pins positioned between said fourth pin and said fifth pin, said hexagonal configuration having:

a first predetermined subset of said loom pins forming a top angled side of said hexagonal configuration;

a second predetermined subset of said loom pins forming a bottom angled side of said hexagonal configuration; and a third predetermined subset of said loom pins forming two opposite straight sides of said hexagonal configuration, said two opposite straight sides connecting to said top angled side and said bottom angled side forming a loom pins spacing for said hexagonal configuration;

at least two of said center pins between said first pin and said fifth pin and at least two of said center pins between said fourth pin and said fifth pin forming a triangular configuration;

bias weaving using said single continuous yarn strand for forming a top woven triangle fabric section, a bottom woven triangle fabric section, and a middle section of parallel yarn strand portions of said single continuous yarn strand, said middle section forming a plurality of weaving warps for continuing to weave using said single continuous yarn strand;

a continuous weaving using said single continuous yarn strand as weft strands in said middle section of parallel yarn strand portions for forming a rectangular woven fabric section with remaining loom pins in said triangular configuration of said pentagonal pattern.

* * * * *